US008154460B2

(12) United States Patent
Sakata et al.

(10) Patent No.: US 8,154,460 B2
(45) Date of Patent: Apr. 10, 2012

(54) WIRELESS COMMUNICATION APPARATUS WITH HOUSING CHANGING BETWEEN OPEN AND CLOSED STATES

(75) Inventors: Tsutomu Sakata, Osaka (JP); Atsushi Yamamoto, Kyoto (JP); Satoru Amari, Osaka (JP)

(73) Assignee: Panasonic Corporation, Osaka (JP)

( * ) Notice: Subject to any disclaimer, the term of this patent is extended or adjusted under 35 U.S.C. 154(b) by 495 days.

(21) Appl. No.: 12/504,980

(22) Filed: Jul. 17, 2009

(65) Prior Publication Data

US 2010/0013720 A1 Jan. 21, 2010

(30) Foreign Application Priority Data

Jul. 18, 2008 (JP) ..... 2008-186859

(51) Int. Cl.
*H01Q 1/24* (2006.01)

(52) U.S. Cl. ..... 343/702; 343/745; 343/749; 343/750; 343/751; 343/752; 343/845; 343/846; 343/860; 343/861; 343/876

(58) Field of Classification Search ..... 343/700 MS, 343/702, 729–730, 745, 749–752, 845–846, 343/850, 860–861, 876
See application file for complete search history.

(56) References Cited

U.S. PATENT DOCUMENTS

| | | | | |
|---|---|---|---|---|
| 7,508,349 | B2 * | 3/2009 | Kanazawa | 343/702 |
| 8,060,167 | B2 * | 11/2011 | Saitou et al. | 455/575.7 |
| 2009/0033566 | A1 * | 2/2009 | Nakanishi et al. | 343/702 |

FOREIGN PATENT DOCUMENTS

| | | |
|---|---|---|
| EP | 1 768 355 | 3/2007 |
| JP | 6-216621 | 8/1994 |
| JP | 2006-67361 | 3/2006 |
| JP | 2007-274518 | 10/2007 |

* cited by examiner

*Primary Examiner* — Jacob Y Choi
*Assistant Examiner* — Shawn Buchanan
(74) *Attorney, Agent, or Firm* — Wenderoth, Lind & Ponack, L.L.P.

(57) ABSTRACT

When first and second housings are in an open state, first and second switches are electrically opened, and thus, a first antenna element and a ground conductor operate as a first dipole antenna, and a second antenna element and the ground conductor operate as a second dipole antenna with isolation from the first dipole antenna by the slit. When the first and second housings are in the closed state, the first and second switches are electrically closed, and thus, the first antenna element operates as a first inverted F antenna on the ground conductor, and the second antenna element operates as a second inverted F antenna on the ground conductor with isolation from the first inverted F antenna by the slit.

8 Claims, 27 Drawing Sheets

WIRELESS COMMUNICATION APPARATUS WITH HOUSING CHANGING BETWEEN OPEN AND CLOSED STATES

BACKGROUND OF THE INVENTION

1. Field of the Invention

The present invention relates to a wireless communication apparatus such as a mobile phone with a housing which is made of two housing portions and which changes between open and closed states. More particularly, the present invention relates to an antenna apparatus for such a wireless communication apparatus.

2. Description of the Related Art

Some mobile phones are configured with a housing which is made of two housing portions and which changes between open and closed states, as shown in FIGS. 26A, 26B, 27A, and 27B. FIGS. 26A and 26B are diagrams respectively showing an open state and a closed state of a clamshell (two-fold) mobile phone according to a prior art. In this mobile phone, an upper housing 101 provided with a speaker, a display, etc. and a lower housing 102 provided with a microphone, a keyboard, etc. are coupled to each other through a hinge portion 103, and can be folded. Further, the upper housing 101 is provided with a first display device 104 and a second display device 105 which are made of liquid crystal displays or organic electro-luminescence displays. When the mobile phone is opened, the first display device 104 shows input information from an information input terminal provided to the lower housing 102, or shows received information, etc. When the mobile phone is closed, the second display device 105 shows received information, the time, etc. FIGS. 27A and 27B are diagrams respectively showing an open state and a closed state of a swivel mobile phone according to a prior art. In this mobile phone, an upper housing 111 provided with a speaker, a display, etc. and a lower housing 112 provided with a microphone, a keyboard, etc. are coupled to each other through a rotating shaft 113 that penetrates the upper housing 111 and the lower housing 112 in their thickness direction (or through an equivalent coupling mechanism). The mobile phone is opened and closed by rotation of the upper housing 111 about the rotating shaft 113. The upper housing 111 is provided with a display device 114 made of a liquid crystal display or organic electro-luminescence display. Whether the mobile phone is opened or closed, the display device 114 shows input information from an information input terminal provided to the lower housing 112, or shows received information, the time, etc.

Patent Document 1 discloses a built-in antenna in a portable wireless communication apparatus. The portable wireless communication apparatus of Patent Document 1 is provided with: a flip portion that is attached to a main body thereof to cover at least a part of the main body and that can be folded; a first metal plate in the flip portion; a second metal plate in the main body; and means for electrically connecting the first and second metal plates when closing the flip portion and for disconnecting when opening the flip portion, and the first and second metal plates are fed with radio-frequency signals at positions remote from the connecting point by certain distances.

Patent Document 2 discloses a portable wireless communication apparatus that uses circuit boards in housings as an antenna. According to the portable wireless communication apparatus of Patent Document 2, an upper housing contains an upper circuit board, a lower housing contains a lower circuit board, the upper and lower circuit boards are electrically connected to each other, and the lower housing further contains an antenna unit at top of the lower housing and contains a feeding unit for feeding the antenna unit. When the portable wireless communication apparatus is in a portable mode in which the upper housing and the lower housing are stacked upon each other, the feeding unit is connected to the antenna unit. When the portable wireless communication apparatus is in a call mode in which the total length is increased by sliding the upper housing and the lower housing, the feeding unit is connected to the upper circuit board through the antenna unit and a connecting member.

Patent Document 3 discloses a clamshell mobile phone having a plurality of antennas, and a method for changing the antennas of the mobile phone. In the mobile phone of Patent Document 3, multiple antennas are provided for each of a plurality of frequency bands, and the antennas for at least one frequency band include an antenna of a type in which its housing is used as a dipole, and another type of antenna. When an open and close detecting unit detects that a housing is closed, and when antennas for a frequency band in use include an antenna of a type in which its housing is used as a dipole, or the like, a CPU (controller) selects another antenna and changes to the another antenna. On the other hand, when the open and close detecting unit detects that the housing is opened, or when antennas for a frequency band in use do not include an antenna of a type in which its housing is used as a dipole, or the like, the CPU measures respective sensitivities when receiving through the antennas for the frequency band, selects an antenna with the highest sensitivity, and changes to the selected antenna.

(1) Patent Document 1: Japanese Patent Laid-open Publication No. H06-216621,
(2) Patent Document 2: Japanese Patent Laid-open Publication No. 2006-067361, and
(3) Patent Document 3: Japanese Patent Laid-open Publication No. 2007-274518.

Recently, as results of reducing the size of mobile phones and utilizing housings changing between open and closed states, it has become difficult to reserve a space to be provided with antenna elements in a mobile phone. Particularly, in order to maximize the electrical length of an antenna of a mobile phone changing between open and closed states, it is common practice to configure a dipole antenna made of an antenna element and a ground conductor by providing the antenna element and the ground conductor separately to a first housing portion and a second housing portion, and providing a feeding point at a position where the antenna element and the ground conductor are close to each other (i.e., a position near a coupling portion between the first and second housing portions), as described in Patent Documents 1 and 2. In such a mobile phone, when a housing of the mobile phone is opened, the antenna element and the ground conductor operate as a dipole antenna as desired. However, when the housing of the mobile phone is closed, since the antenna element in the first housing portion and the ground conductor in the second housing portion oppose to each other, current flowing through the antenna element and current flowing through the ground conductor cancel each other out, and thus the antenna element and the ground conductor cannot operate as a dipole antenna. Accordingly, in order to perform communication when a conventional mobile phone is closed, it is necessary to add a separate and dedicated antenna element to be used in the closed state, as described in Patent Document 3. Hence, a mobile phone is required that is provided with a novel antenna apparatus capable of transmitting or receiving, regardless of whether a housing of the mobile phone is opened or closed.

Additionally, antenna apparatuses have recently appeared that use the MIMO (Multi-Input Multi-Output) technique for simultaneously transmitting or receiving radio signals of multiple channels by the spatial division multiplexing, in order to increase communication capacity and thus achieve high-speed communication. An antenna apparatus for MIMO communication needs to simultaneously transmit or receive a plurality of radio signals with different directivities, polarization characteristics, etc., and thus with low correlations to each other, in order to achieve the spatial division multiplexing.

SUMMARY OF THE INVENTION

An object of the present invention is therefore to solve the above-described problems, and provide a wireless communication apparatus capable of transmitting or receiving, regardless of whether a housing of the wireless communication apparatus is opened or closed, and capable of simultaneously transmitting or receiving a plurality of radio signals with low correlations to each other.

According to the aspect of the present invention, a wireless communication apparatus is provided, including: first and second housings coupled to each other through a coupling portion so as to change between open and closed states; first and second antenna elements provided to the first housing with a distance between the first and second antenna elements; a slit between the first and second antenna elements in the first housing; first and second feeding points respectively provided on the first and second antenna elements such that the slit is located between the first and second feeding points; a ground conductor provided to the second housing; a first switch for electrically connecting and disconnecting the first antenna element to and from the ground conductor; and a second switch for electrically connecting and disconnecting the second antenna element to and from the ground conductor. When the first and second housings are in the open state, the first and second switches are electrically opened, and thus, the first antenna element and the ground conductor operate as a first dipole antenna, and the second antenna element and the ground conductor operate as a second dipole antenna with isolation from the first dipole antenna by the slit. When the first and second housings are in the closed state, the first and second switches are electrically closed, and thus, the first antenna element operates as a first inverted F antenna on the ground conductor, and the second antenna element operates as a second inverted F antenna on the ground conductor with isolation from the first inverted F antenna by the slit.

Moreover, the wireless communication apparatus further includes: a third switch for electrically connecting and disconnecting the first and second antenna elements with each other at a first end of the slit; a fourth switch for electrically connecting and disconnecting the first and second antenna elements with each other at a second end of the slit; and a controller for controlling the third and the fourth switch. When the first and second housings are in the open state, the controller closes the third switch and opens the fourth switch, and when the first and second housings are in the closed state, the controller opens the third switch and closes the fourth switch.

Furthermore, the wireless communication apparatus further includes: a first variable capacitance element connected between the first and second antenna elements at the first end of the slit; and a second variable capacitance element connected between the first and second antenna elements at the second end of the slit. When the first and second housings are in the open state, the controller controls a reactance value of the second variable capacitance element so as to minimize reflection coefficients of the first and second dipole antennas, and when the first and second housings are in the closed state, the controller controls a reactance value of the first variable capacitance element so as to minimize reflection coefficients of the first and second inverted F antennas.

Moreover, the wireless communication apparatus further includes a variable capacitance element connected between the first and second antenna elements at a position between the first and second ends of the slit. When the first and second housings are in the open state, the controller controls a reactance value of the variable capacitance element so as to minimize reflection coefficients of the first and second dipole antennas, and when the first and second housings are in the closed state, the controller controls the reactance value of the variable capacitance element so as to minimize reflection coefficients of the first and second inverted F antennas.

Furthermore, the wireless communication apparatus further includes: a first variable capacitance element connected between the first and second antenna elements at a first end of the slit; a second variable capacitance element connected between the first and second antenna elements at a second end of the slit; and a controller for controlling the first and second variable capacitance elements. When the first and second housings are in the open state, the controller controls a reactance value of the first variable capacitance element such that the first variable capacitance element is substantially short-circuited, and controls a reactance value of the second variable capacitance element so as to minimize reflection coefficients of the first and second dipole antennas, and when the first and second housings are in the closed state, the controller controls the reactance value of the second variable capacitance element such that the second variable capacitance element is substantially short-circuited, and controls the reactance value of the first variable capacitance element so as to minimize reflection coefficients of the first and second inverted F antennas.

Moreover, in the wireless communication apparatus, the controller further controls the first and second switches such that when the first and second housings are in the open state, the first and second switches are electrically opened, and when the first and second housings are in the closed state, the first and second switches are electrically closed.

Furthermore, in the wireless communication apparatus, the first and second housings are coupled to each other so as to change between the open and closed states in a two-fold manner at the coupling portion.

Moreover, in the wireless communication apparatus, the coupling portion includes a rotating shaft that penetrates the first and second housings in their thickness direction, and the first and second housings are coupled to each other so as to change between the open and closed states by rotating about the rotating shaft.

According to the present invention, even when the first and second housings are closed, it is possible to avoid that currents flowing through the first and second antenna elements and currents flowing through the ground conductor are cancelled each other out. Accordingly, there is no need to provide different antenna elements for the dipole antenna and for the inverted F antenna, thus achieving size reduction. In addition, a parasitic slit is formed between the first and second antenna elements along the entire lengths of the first and second antenna elements, and is preferably orthogonal to a virtual line passing through the first and second feeding points, thus achieving certain isolation between radio waves generated by feeding at the first and second feeding points. Thus, the isolation can be improved between the radio wave generated by feeding at the feeding point of the first antenna element, and the radio wave generated by feeding at the feeding point of the second antenna element. Accordingly, each of the first and second antenna elements can operate as an antenna element, thus improving communication speed.

When forming a slit along the entire length of an antenna element, it results in reducing the antenna area, and accordingly, reducing the electrical length of a current flowing through the antenna element. Hence, the resonant frequency is shifted to a higher frequency, and accordingly, desired frequency characteristics cannot be obtained. According to the present invention, when the first and second housings are opened, the electrical lengths of currents flowing through the first and second antenna elements increase, by connecting the first and second antenna elements at a first end of the parasitic slit, i.e., an end remote from the coupling portion. Accordingly, a resonant frequency of both the first and second antenna elements is shifted to a lower frequency, thus widening the frequency bandwidth. In addition, according to the present invention, when the first and second housings are closed, the electrical lengths of currents flowing through the first and second antenna elements increase, by connecting the first and second antenna elements at a second end of the parasitic slit, i.e., an end close to the coupling portion. Accordingly, a resonant frequency of both the first and second antenna elements is shifted to a lower frequency, thus widening the frequency bandwidth.

According to the present invention, since the slit is located between the first and second feeding points, it is possible to achieve certain isolation between the first and second feeding points. In addition, when the first and second housings are opened, the electrical lengths of currents flowing through the first and second antenna elements increase, by connecting the first and second antenna elements at the first end of the parasitic slit, i.e., the end remote from the coupling portion. Accordingly, the resonant frequency of both the first and second antenna elements can be shifted to a lower frequency, thus widening the frequency bandwidth. In addition, according to the present invention, when the first and second housings are closed, the electrical lengths of currents flowing through the first and second antenna elements increase, by connecting the first and second antenna elements at the second end of the parasitic slit, i.e., the end close to the coupling portion. Accordingly, the resonant frequency of both the first and second antenna elements is shifted to a lower frequency, thus widening the frequency bandwidth.

According to the present invention, only by changing voltages applied to the first and second variable capacitance elements, it is possible to make and break the connection between the first and second antenna elements, and change the electrical length of the parasitic slit to virtually changes a path of a current flowing around the parasitic slit, thus adjusting the resonant frequency of the first and second antenna elements. Therefore, the number of components can be reduced.

According to the present invention, even when a communication frequency changes, and thus a difference has increased between the resonant frequency of the first and second antenna elements and the communication frequency, it is possible to appropriately adjust the resonant frequency of the first and second antenna elements for the communication frequency, by changing the electrical length of the parasitic slit according to the change in the communication frequency to virtually change a path of a current flowing around the parasitic slit, thus achieving substantially variable adjustment to the resonant frequency of the first and second antenna elements. Moreover, a variable capacitance element for adjusting the resonant frequency of the parasitic slit is provided between the first and second ends of the parasitic slit, and accordingly, it is sufficient for the present invention to provide only one variable capacitance element along the parasitic slit, thus reducing the number of components and the cost.

According to the present invention, the first and second variable capacitance elements can be provided at arbitrary positions different from a position at which the first and second antenna elements are connected and which changes according to whether the first and second housings are opened or closed, and accordingly, the first and second variable capacitance elements can be provided at optimal positions along the slit where the electric field strength of the parasitic slit increases, according to whether the first and second housings are opened or closed. As a result, it is possible to use variable capacitance elements with a small capacitance value to adjust the resonant frequency of the slit, thus reducing the size of the variable capacitance elements to be used.

According to the present invention, even when the first and second housings are closed, it is possible to avoid that currents flowing through the first and second antenna elements and currents flowing through the ground conductor are cancelled each other out. Accordingly, there is no need to provide different antenna elements for dipole antennas and for inverted F antennas, thus achieving size reduction.

A parasitic slit is formed between the first and second antenna elements along the entire lengths of the first and second antenna elements, and is preferably orthogonal to a virtual line passing through the first and second feeding points, and thus achieving certain isolation between radio waves generated by feeding at the first and second feeding points. Thus, the isolation can be improved between the radio wave generated by feeding at the feeding point of the first antenna element, and the radio wave generated by feeding at the feeding point of the second antenna element. Accordingly, each of the first and second antenna elements can operate as an antenna element, thus improving communication speed.

According to the present invention, the present invention can be implemented as a mobile phone for, e.g., MIMO communication. But not limited to MIMO communication, the present invention can also be implemented as a mobile phone that can simultaneously perform communications for multiple applications (multi-application).

BRIEF DESCRIPTION OF THE DRAWINGS

Various objects, features, and advantages of the present invention will be disclosed as preferred embodiments which are described below with reference to the accompanying drawings.

DETAILED DESCRIPTION OF THE PREFERRED EMBODIMENTS

Figure 1A:
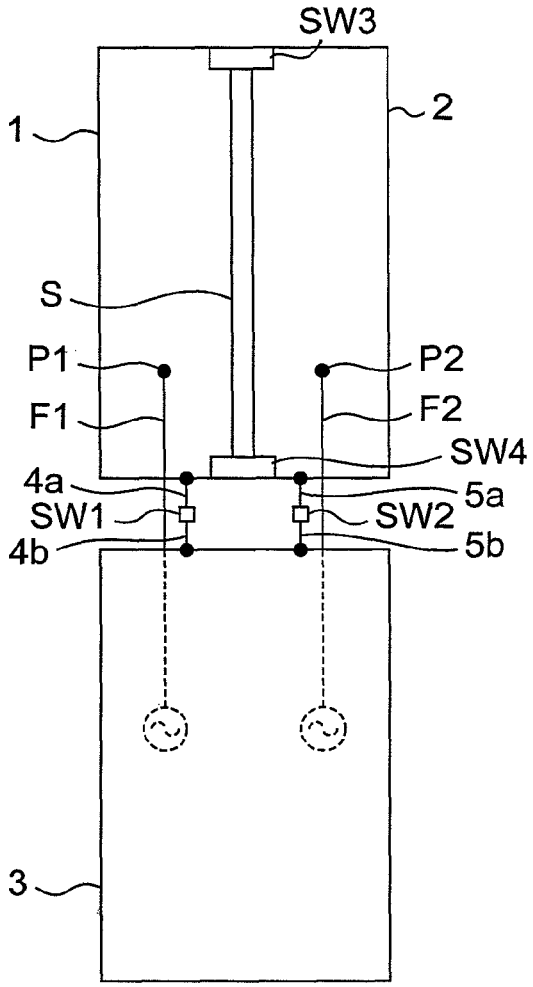
FIG. 1A is a schematic diagram showing an antenna apparatus in its open state, according to a first preferred embodiment of the present invention.

Preferred embodiments of the present invention will be described in detail below with reference to the drawings. Note that components of similar functions are denoted by the same reference numerals throughout the drawings.

First Preferred Embodiment

Figure 1B:
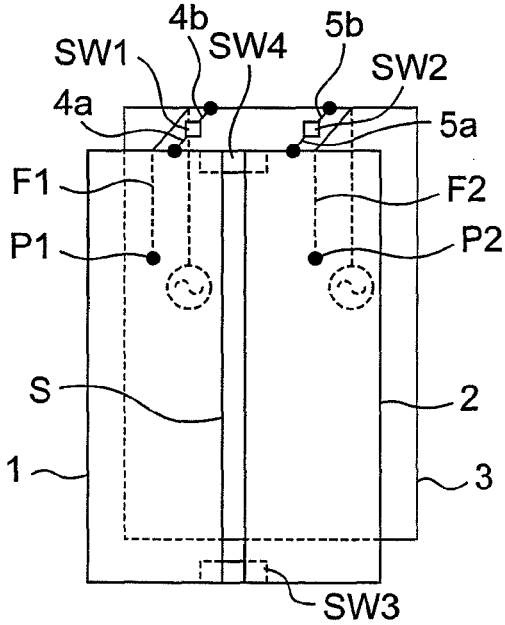
FIG. 1B is a schematic diagram showing the antenna apparatus of FIG. 1A in its closed state.
Figure 2A:
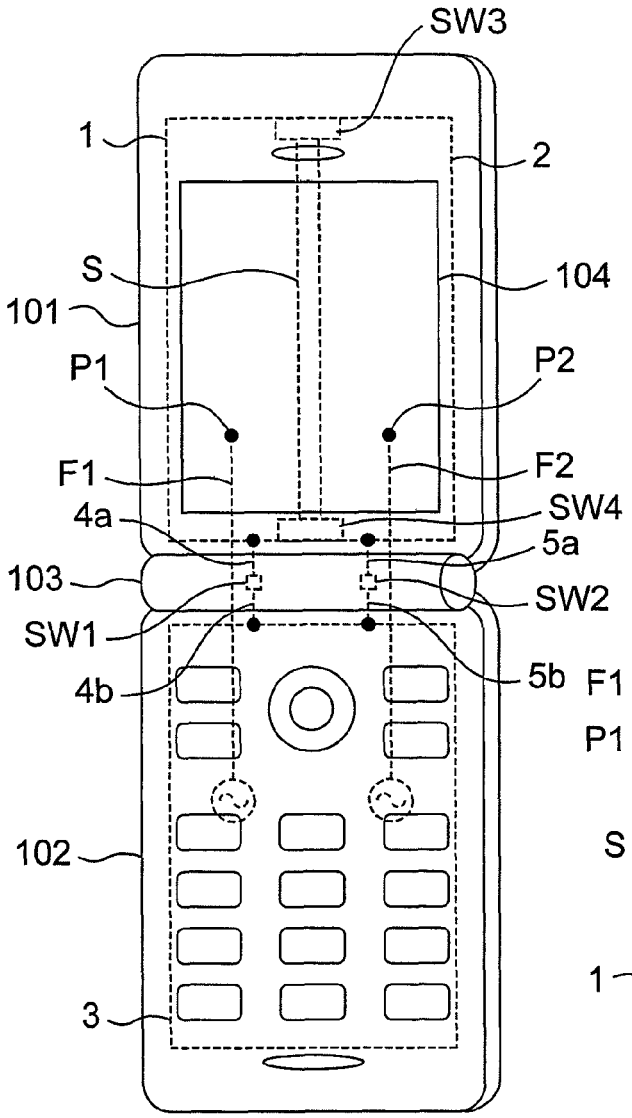
FIG. 2A is a schematic diagram showing an implementation of a mobile phone in its open state, provided with the antenna apparatus of FIG. 1A shown in phantom.
Figure 2B:
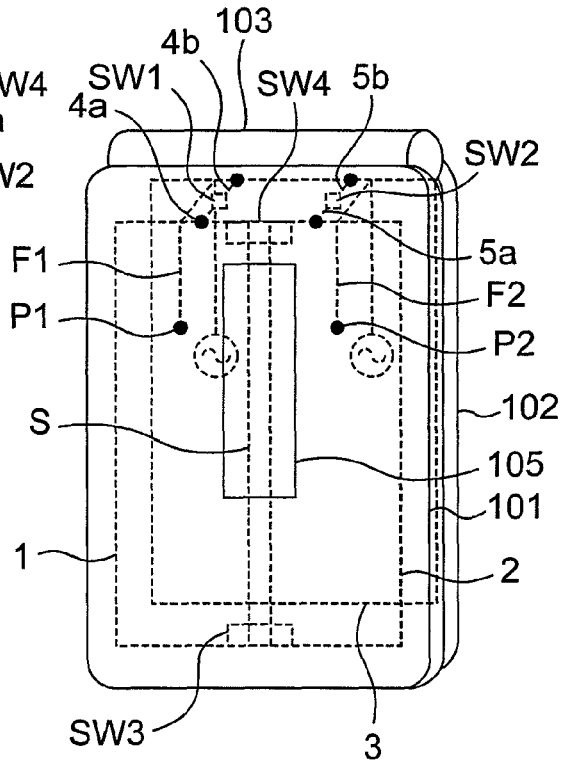
FIG. 2B is a schematic diagram showing the mobile phone of FIG. 2A in its closed state.
Figure 3A:
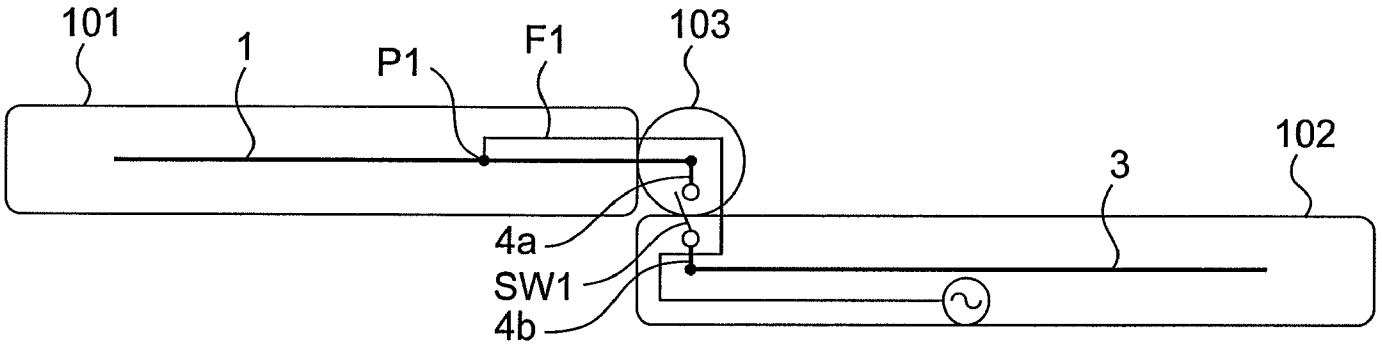
FIG. 3A is a longitudinal cross-sectional view of the mobile phone in its open state as shown in FIG. 2A.
Figure 3B:
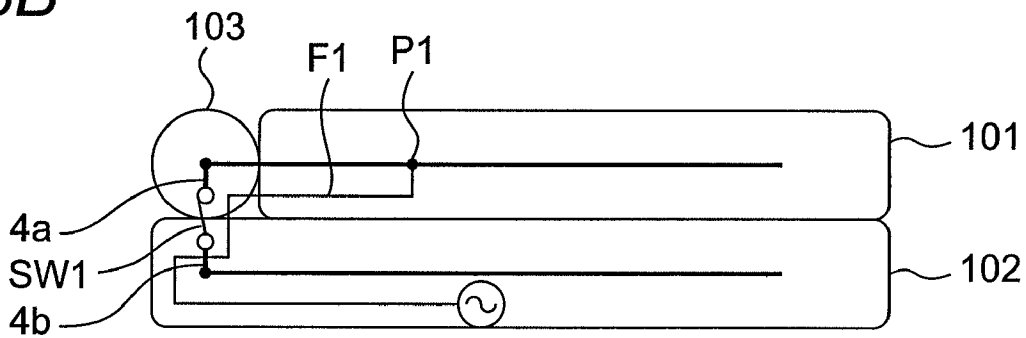
FIG. 3B is a longitudinal cross-sectional view of the mobile phone in its closed state as shown in FIG. 2B.
Figure 4:
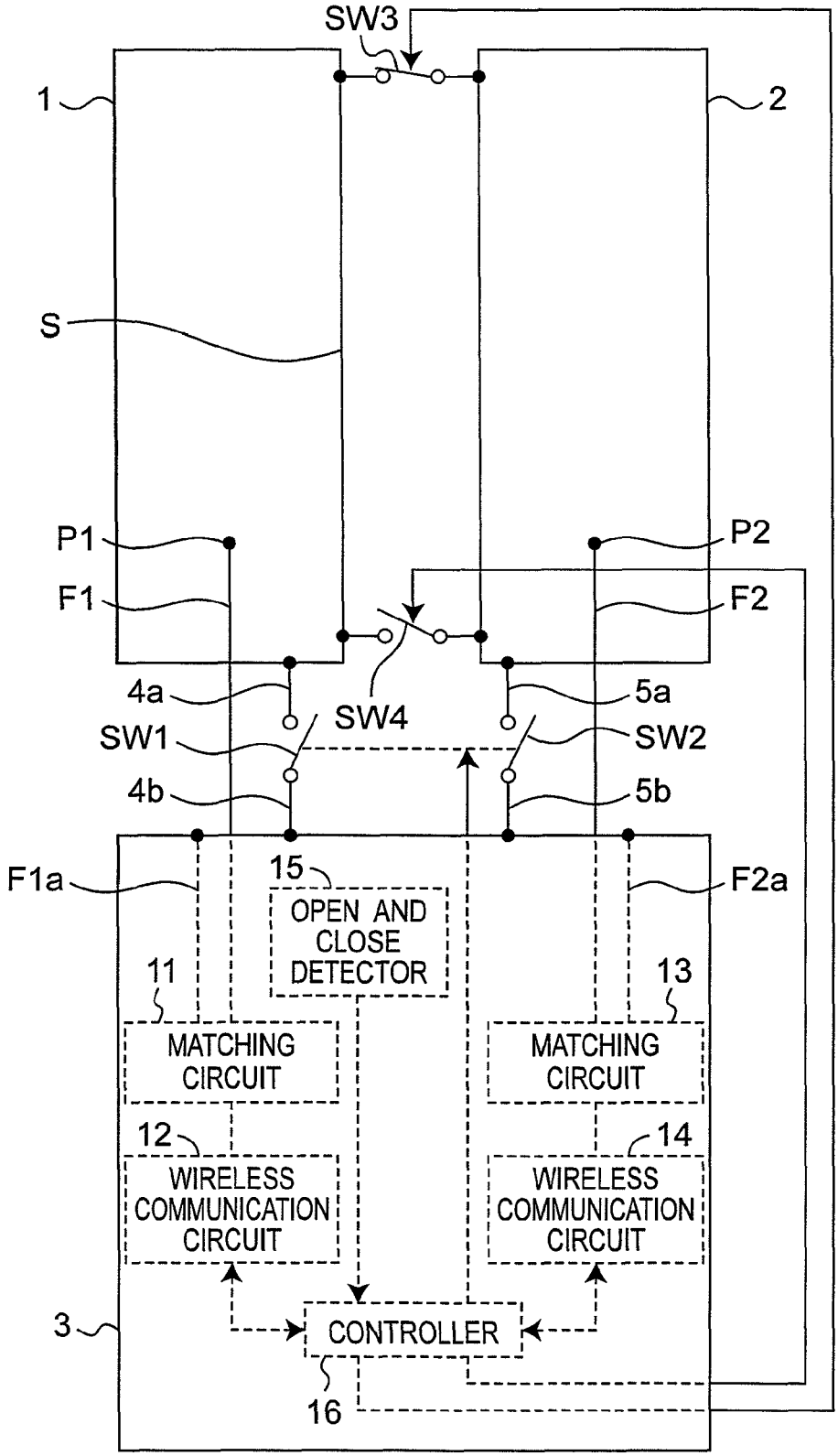
FIG. 4 is a block diagram showing a circuit configuration of the antenna apparatus of FIG. 1A in its open state.
Figure 5:
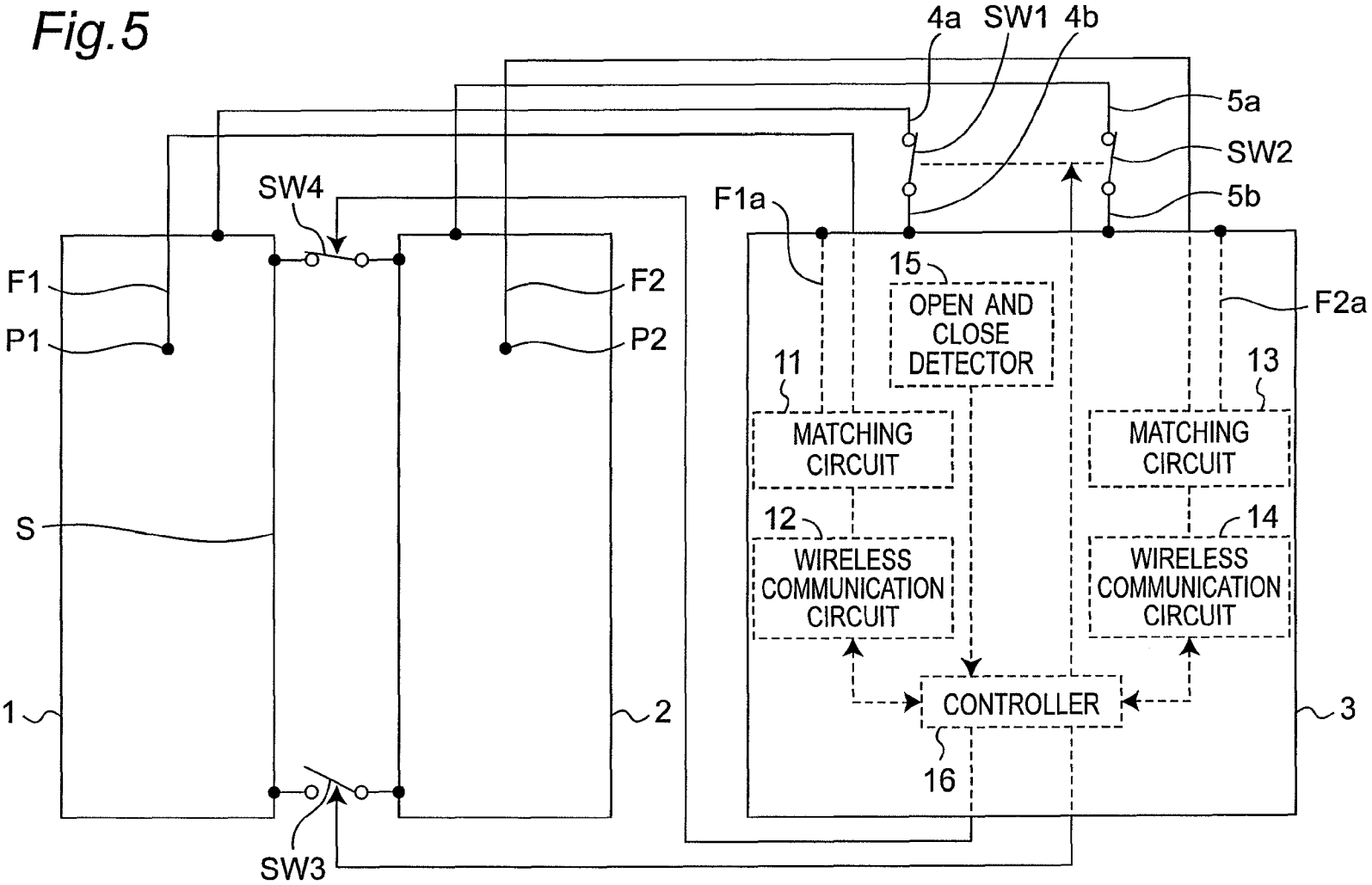
FIG. 5 is a block diagram showing a circuit configuration of the antenna apparatus of FIG. 1B in its closed state.

FIG. 1A is a schematic diagram showing an antenna apparatus in its open state, according to a first preferred embodiment of the present invention. FIG. 1B is a schematic diagram showing the antenna apparatus of FIG. 1A in its closed state. FIGS. 2A, 2B, 3A, and 3B are schematic diagrams showing an implementation of a mobile phone provided with the antenna apparatus of FIGS. 1A and 1B. FIGS. 4 and 5 are block diagrams showing a circuit configuration of the antenna apparatus of FIGS. 1A and 1B.

Referring to FIG. 1A, the antenna apparatus includes two antenna elements 1 and 2, each made of a conducting plate having at least one linear edge. The antenna elements 1 and 2 are opposed to each other at respective one edges thereof so as to be close to each other, thus resulting in a parasitic slit S formed between the antenna elements 1 and 2. As shown in FIGS. 2A and 2B, the parasitic slit S is provided in parallel to a longitudinal direction of a mobile phone (i.e., an up-down direction in FIGS. 1A, 1B, 2A, and 2B). The antenna apparatus further includes a ground conductor 3 made of a conducting plate and close to the antenna elements 1 and 2. A portion of an outer edge of the ground conductor 3 (in FIG. 1A, an upper end portion of the ground conductor 3) is opposed to one end of the parasitic slit S (in FIG. 1A, a lower end), and opposed to respective portions of the antenna elements 1 and 2 close to the same end of the parasitic slit S (in FIG. 1A, lower end portions). In the present preferred embodiment, each of the antenna elements 1 and 2 and the ground conductor 3 is rectangular. In the following description, a side of each of the antenna elements 1 and 2 and the ground conductor 3 in FIG. 1A facing forward is referred to as "front side", and a side facing backward is referred to as "back side". Feeding points P1 and P2 are respectively provided at certain positions on the antenna elements 1 and 2. The parasitic slit S is located between the feeding points P1 and P2, and accordingly, certain isolation is achieved between the feeding points P1 and P2. The feeding points P1 and P2 are preferably located at positions symmetric to the parasitic slit S, and a straight line passing through the feeding points P1 and P2 is orthogonal to the parasitic slit S. The feeding points P1 and P2 are respectively connected through feeding lines F1 and F2 to radio-frequency circuits (described in detail below) provided on the back side of the ground conductor 3. The antenna element 1 can be electrically connected to and disconnected from the ground conductor 3, at its one end opposed to the ground conductor 3, through short-circuit conductors 4*a* and 4*b* which include a switch SW1 therebetween. Similarly, the antenna element 2 can be electrically connected to and disconnected from the ground conductor 3, at its end opposed to the ground conductor 3, through short-circuit conductors 5*a* and 5*b* which include a switch SW2 therebetween. At one of two ends of the parasitic slit S that is opposed to the ground conductor 3 (in FIG. 1A, a lower end of the parasitic slit S), a switch SW4 is provided for electrically connecting and disconnecting the antenna elements 1 and 2, and at the other end (in FIG. 1A, an upper end), a switch SW3 is provided for electrically connecting and disconnecting the antenna elements 1 and 2. When the antenna apparatus is opened as shown in FIG. 1A, a controller of the antenna apparatus (described in detail below) controls the switches SW1 and SW2 to open, and the antenna element 1 and the ground conductor 3 operate as a dipole antenna by means of excitation through the feeding point P1, and similarly, the antenna element 2 and the ground conductor 3 also operate as a dipole antenna by means of excitation through the feeding point P2. Because of the parasitic slit S, the two dipole antennas operate with certain isolation therebetween. Furthermore, when the antenna apparatus is opened, the controller of the antenna apparatus controls the switch SW3 to close and the switch SW4 to open along the parasitic slit S, and accordingly, a current path is formed that passes through the switch SW3 and extends over both the antenna elements 1 and 2, thus contributing to widening the bandwidth of the antenna apparatus.

As shown in FIG. 1B, the antenna apparatus according to the present preferred embodiment is closed in a two-fold manner at a location where the antenna elements 1 and 2 are opposed to the ground conductor 3 in FIG. 1A (i.e., a location where the short-circuit conductors 4*a*, 4*b*, 5*a*, and 5*b* and the switches SW1 and SW2 are provided). When the antenna apparatus is closed, the antenna elements 1 and 2 are arranged close to the ground conductor 3 such that entire areas of the antenna elements 1 and 2 substantially overlaps an area of the ground conductor 3. The feeding lines F1 and F2 are provided so as to be connected to the feeding points P1 and P2 from sides on the antenna elements 1 and 2 and close to the ground conductor 3 when the antenna apparatus is closed. The feeding lines F1 and F2 go to the back side of the ground conductor 3 via an edge of the ground conductor 3 (or via holes provided close to the edge), and are then connected to the radio-frequency circuits. The radio-frequency circuits are provided to be located on the outer side of the ground conductor 3 when the mobile phone is closed, that is, provided so as not to be located between the antenna elements 1 and 2 and the ground conductor 3. When the antenna apparatus is closed, the controller of the antenna apparatus controls the switches SW1 and SW2 to close, and thus, the antenna elements 1 and 2 are short-circuited to the ground conductor 3. Furthermore, when the antenna apparatus is closed, the antenna element 1 operates as an inverted F antenna on the ground conductor 3 by means of excitation through the feeding line F1 connected to the feeding point P1, and similarly, the antenna element 2 also operates as an inverted F antenna on the ground conductor 3 by means of excitation through the feeding line F2 connected to the feeding point P2. Because of the parasitic slit S, the two inverted F antennas operate with certain isolation therebetween. Furthermore, when the antenna apparatus is closed, the controller of the antenna apparatus controls the switch SW3 to open and the switch SW4 to close, and accordingly, a current path is formed that passes through the switch SW4 and includes both the antenna elements 1 and 2, thus contributing to widening the bandwidth of the antenna apparatus.

According to the antenna apparatus according to the present preferred embodiment, the switches SW1 and SW2 are provided between the antenna elements 1 and 2 and the ground conductor 3. When the antenna apparatus is opened, the antenna apparatus to operate as two dipole antennas by opening the switches SW1 and SW2. When the antenna apparatus is closed, the antenna apparatus to operate as two inverted F antennas by closing the switches SW1 and SW2. Accordingly, even in the closed state, it is possible to avoid that currents flowing through the first and second antenna elements 1 and 2 and currents flowing through the ground conductor 3 are cancelled each other out. Accordingly, there is no need to add separate and dedicated antenna elements to be used in the closed state, thus achieving size reduction. Moreover, according to the antenna apparatus according to the present preferred embodiment, the parasitic slit S is provided between the antenna elements 1 and 2 for achieving certain isolation between the feeding points P1 and P2, thus improving isolation between the two dipole antennas and isolation between the two inverted F antennas. Accordingly, the antenna apparatus can operate as two independent antennas for, e.g., MIMO communication, thus improving communication speed.

Figure 26A:
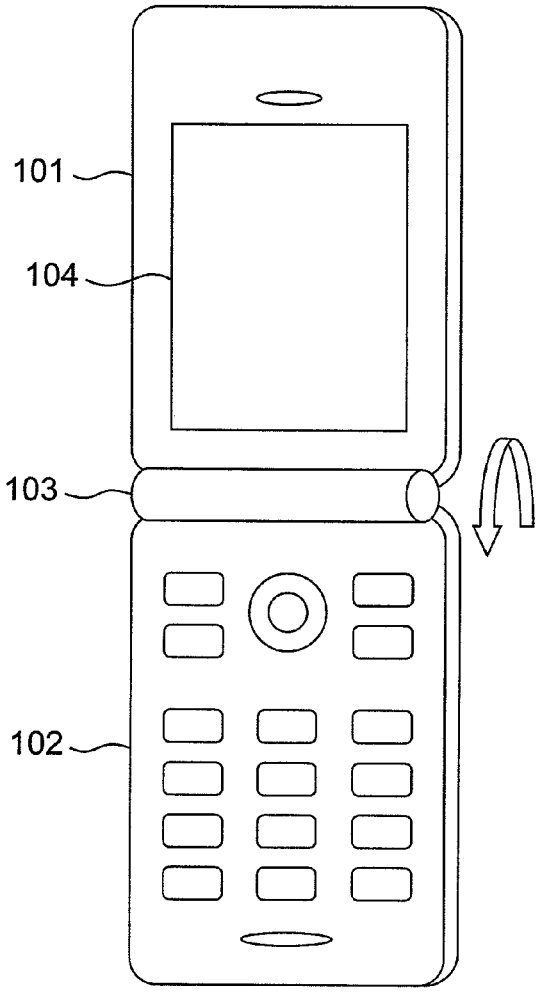
Fig.26A PRIOR ART
FIG. 26A is a diagram showing a conventional clamshell mobile phone in its open state.
Figure 26B:
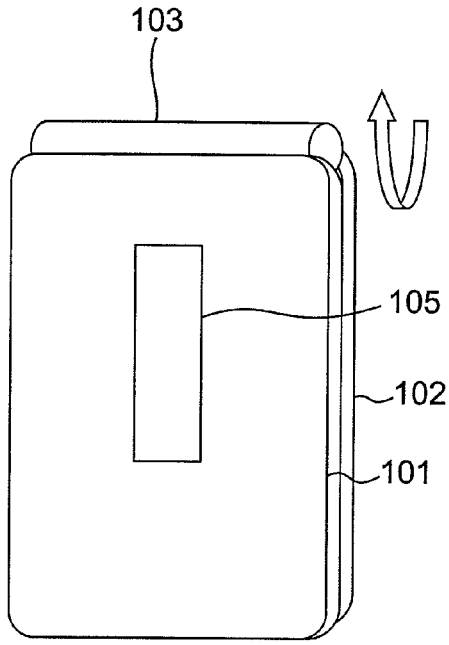
Fig.26B PRIOR ART
FIG. 26B is a diagram showing the clamshell mobile phone of FIG. 26A in its closed state.

FIG. 2A is a schematic diagram showing an implementation of a mobile phone in its open state, provided with the antenna apparatus of FIG. 1A shown in phantom. FIG. 2B is a schematic diagram showing the mobile phone of FIG. 2A in its closed state. FIG. 3A is a longitudinal cross-sectional view of the mobile phone in its open state as shown in FIG. 2A. FIG. 3B is a longitudinal cross-sectional view of the mobile phone in its closed state as shown in FIG. 2B. The longitudinal cross-sectional views of FIGS. 3A and 3B schematically show only some of the components shown in FIGS. 1A and 1B. A housing of the mobile phone of FIGS. 2A, 2B, 3A, and 3B is configured in the same manner as that of the conventional mobile phone described with reference to FIGS. 26A and 26B. The antenna elements 1 and 2 are provided within an upper housing 101 such that the parasitic slit S between the antenna elements 1 and 2 is parallel to a longitudinal direction of the mobile phone, that is, the parasitic slit S is provided within the upper housing 101 so as to extend between a position close to a hinge portion 103 and a position remote from the hinge portion 103 (in FIG. 2A, an upper end portion). The ground conductor 3 is provided within a lower housing 102. The upper housing 101 and the lower housing 102 are coupled to each other by the hinge portion 103, and can be folded. When folding the mobile phone, the antenna elements 1 and 2 and the ground conductor 3 are folded at the hinge portion 103 and thus changed to the closed state.

The upper housing 101 is provided with a first display device 104 and a second display device 105 each made of a liquid crystal display or organic electro-luminescence display. When the mobile phone is opened, the first display device 104 shows input information from an information input terminal provided to the lower housing 102, or shows received information, etc. When the mobile phone is closed, the second display device 105 shows received information, the time, etc.

FIG. 4 is a block diagram showing a circuit configuration of the antenna apparatus of FIG. 1A in its open state. FIG. 5 is a block diagram showing a circuit configuration of the antenna apparatus of FIG. 1B in its closed state. As shown in FIGS. 4 and 5, the radio-frequency circuits of the antenna apparatus include: impedance matching circuits (hereinafter, referred to as the "matching circuits") 11 and 13, and wireless communication circuits 12 and 14, which are provided on the back side of the ground conductor 3 (i.e., the outer side of the ground conductor 3 when the mobile phone is closed). The antenna apparatus further includes: an open and close detector 15 for detecting whether the antenna apparatus is opened or closed; and a controller 16 for controlling the wireless communication circuits 12 and 14 and the switches SW1, SW2, SW3, and SW4. The feeding line F1 connected to the feeding point P1 goes to the back side of the ground conductor 3 via an edge of the ground conductor 3 (or via a hole provided close to the edge), and is then connected through the matching circuit 11 to the wireless communication circuit 12. Similarly, the feeding line F2 connected to the feeding point P2 goes to the back side of the ground conductor 3 via the edge of the ground conductor 3 (or via a hole provided close to the edge), and is then connected through the matching circuit 13 to the wireless communication circuit 14. The feeding lines F1 and F2 may be partially configured as coaxial cables with external conductors F1*a* and F2*a*, respectively. In this case, the external conductors F1*a* and F2*a* are electrically connected to the edge of the ground conductor 3. The wireless communication circuits 12 and 14 perform modulation and demodulation for MIMO communication under control of the controller 16. As described above, when the antenna apparatus is opened, the controller 16 controls the switches SW1 and SW2 to open, and further controls the switch SW3 to close and the switch SW4 to open. When the antenna apparatus is closed, the controller 16 controls the switches SW1 and SW2 to close, and further controls the switch SW3 to open and the switch SW4 to close.

In the present preferred embodiment, the parasitic slit S is preferably provided along the entire length of the entire antenna elements 1 and 2 in the longitudinal direction, as shown in FIGS. 1A and 1B, etc., for electrically isolating the antenna elements 1 and 2, thus reducing the areas of the antenna elements 1 and 2, and accordingly, reducing the electrical lengths of currents flowing through the antenna elements 1 and 2 (i.e., the lengths of current paths). Hence, the resonant frequency of the antenna elements 1 and 2 is shifted to a higher frequency, and accordingly, desired frequency characteristics cannot be obtained. In the present preferred embodiment, the switch SW3 is closed when the antenna apparatus is opened, and the switch SW4 is closed when the antenna apparatus is closed, thus ensuring the lengths of current paths and achieving broadband frequency characteristics, as will be described in detail below with reference to FIGS. 6A, 6B, 7A, and 7B.

Figure 6A:
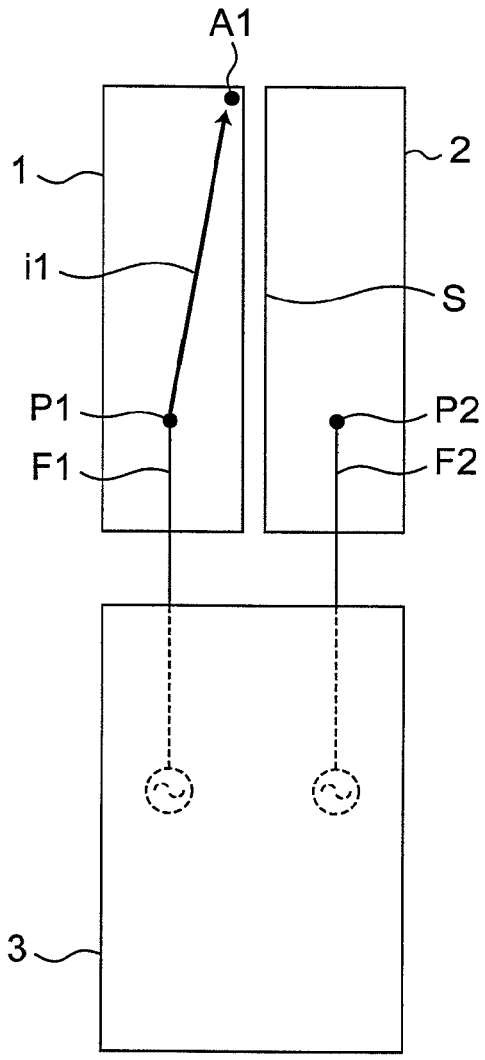
FIG. 6A is a schematic diagram showing a current path for when switches SW3 and SW4 are opened in the antenna apparatus of FIG. 1A.
Figure 6B:
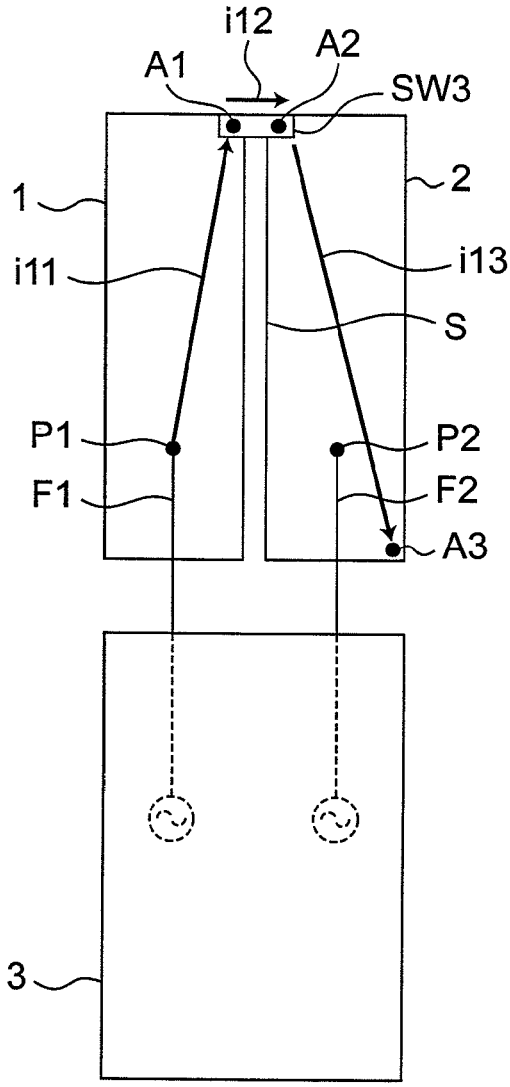
FIG. 6B is a schematic diagram showing a current path for when the switch SW3 of FIG. 6A is closed.

FIG. 6A is a schematic diagram showing a current path for when switches SW3 and SW4 are opened in the antenna apparatus of FIG. 1A. FIG. 6B is a schematic diagram showing a current path for when the switch SW3 of FIG. 6A is closed. For purpose of explanation, in FIG. 6A, the switches SW1, SW2, SW3, and SW4 and the short-circuit conductors 4*a*, 4*b*, 5*a*, and 5*b* are omitted, and in FIG. 6B, the switches SW1, SW2, and SW4 and the short-circuit conductors 4*a*, 4*b*, 5*a*, and 5*b* are omitted. When the switches SW3 and SW4 are opened as shown in FIG. 6A, a radio-frequency current arriving at the feeding point P1 through the feeding line F1 flows toward a point on the antenna element 1 most remote from the feeding point P1, that is, in the present preferred embodiment, the current flows toward a point A1 close to the parasitic slit S and at an edge of the antenna element 1 remote from the ground conductor 3 (current i1). In this case, when the switch SW3 is closed, a current flows from the feeding point P1 toward the switch SW3 (current i11), passes through the switch SW3 from the point A1 on the antenna element 1 to a point A2 on the antenna element 2 (current i12), and then, flows toward a point A3 on the antenna element 2 most remote from the switch SW3 (current i13). As such, when closing the switch SW3, a current path is formed, leading from the antenna element 1 to the antenna element 2 through the switch SW3. Similarly, when a radio-frequency current is fed to the feeding point P2 through the feeding line F2, too, a current path is formed, leading from the antenna element 2 to the antenna element 1 through the switch SW3.

As such, when the antenna apparatus is opened in the present preferred embodiment, the lengths of current paths of radio-frequency currents fed to the antenna elements 1 and 2 increase by connecting the antenna elements 1 and 2 by the switch SW3. Accordingly, the resonant frequency, at which the antenna elements 1 and 2 are respectively excited through the feeding points P1 and P2, can be shifted to a lower frequency as compared to the case of exciting only one of the antenna elements 1 and 2. As a result, desired frequency characteristics can be obtained.

Figure 7A:
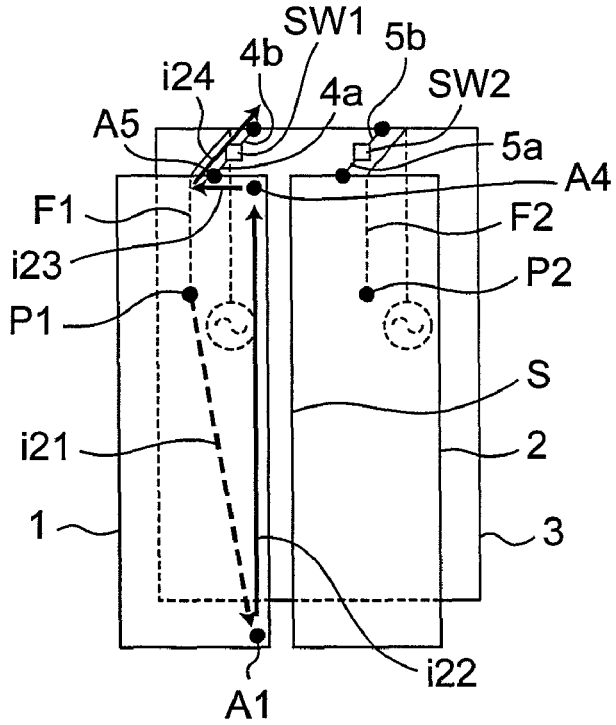
FIG. 7A is a schematic diagram showing a current path for when the switches SW3 and SW4 are opened in the antenna apparatus of FIG. 1B.
Figure 7B:
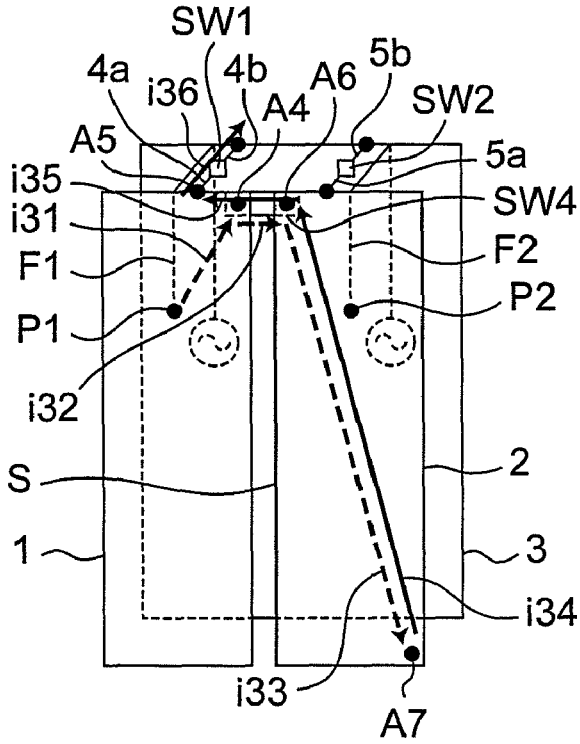
FIG. 7B is a schematic diagram showing a current path for when the switch SW4 of FIG. 7A is closed.

FIG. 7A is a schematic diagram showing a current path for when the switches SW3 and SW4 are opened in the antenna apparatus of FIG. 1B. FIG. 7B is a schematic diagram showing a current path for when the switch SW4 of FIG. 7A is closed. In FIGS. 7A and 7B, the switches SW1 and SW2 are also closed. For purpose of explanation, in FIG. 7A, the switches SW3 and SW4 are omitted, and in FIG. 7B, the switch SW3 is omitted. When the switches SW3 and SW4 are opened as shown in FIG. 7A, a radio-frequency current arriving at the feeding point P1 through the feeding line F1 once flows toward a point A1 on the antenna element 1 most remote from the feeding point P1, along the back side of the antenna element 1 (i.e., a side of the antenna element 1 close to the ground conductor 3) (current i21). Then, the current flows toward a point A5 connected to the short-circuit conductor 4*a*, on the front side of the antenna element 1 along an outer edge of the antenna element 1, that is, in the present preferred embodiment, the current flows from the point A1 toward a point A4 at a remote end of the parasitic slit S (current i22), and then flows from the point A4 toward the point A5 (current i23). In this case, since the current density at an edge of the parasitic slit S increases, the current flows from the point A1 to the point A4 through a path along the parasitic slit S. Then, the current flows from the point A5 through the short-circuit conductors 4*a* and 4*b* and the switch SW1 to the ground conductor 3 (current i24). Then, when the switch SW4 is closed, a current once flows toward a point on the antenna elements 1 and 2 most remote from the feeding point P1, that is, in the present preferred embodiment, the current flows from the feeding point P1 toward the switch SW4 along the back side of the antenna element 1 (current i31), passes through the switch SW4 from the point A4 on the antenna element 1 to a point A6 on the antenna element 2 (current i32), and flows toward a point A7 most remote from the switch SW4, along the back side of the antenna element 2 (current i33). Subsequently, the current flows toward the point A5 connected to the short-circuit conductor 4*a*, on the front side of the antenna elements 1 and 2, that is, in the present preferred embodiment, the current flows from the point A7 toward the point A6 (current i34), and passes through the switch SW4 from the point A6 to the point A4, and flows to the point A5 (current i35). Then, the current flows from the point A5 through the short-circuit conductors 4*a* and 4*b* and the switch SW1 to the ground conductor 3 (current i36). As such, when closing the switch SW4, a current path is formed, leading from the antenna element 1 to the antenna element 2 through the switch SW4 and returning again to the antenna element 1 and then leading to the ground conductor 3. Similarly, when a radio-frequency current is fed to the feeding point P2 through the feeding line F2, a current path is formed, leading from the antenna element 2 to the antenna element 1 through the switch SW4 and returning again to the antenna element 2 and then leading to the ground conductor 3.

As such, when the antenna apparatus is closed in the present preferred embodiment, the lengths of current paths of radio-frequency currents fed to the antenna elements 1 and 2 increase by connecting the antenna elements 1 and 2 by the switch SW4. Accordingly, the resonant frequency, at which the antenna elements 1 and 2 are respectively excited through the feeding points P1 and P2, can be shifted to a lower frequency as compared to the case of exciting only one of the antenna elements 1 and 2. As a result, desired frequency characteristics can be obtained.

Figure 8:
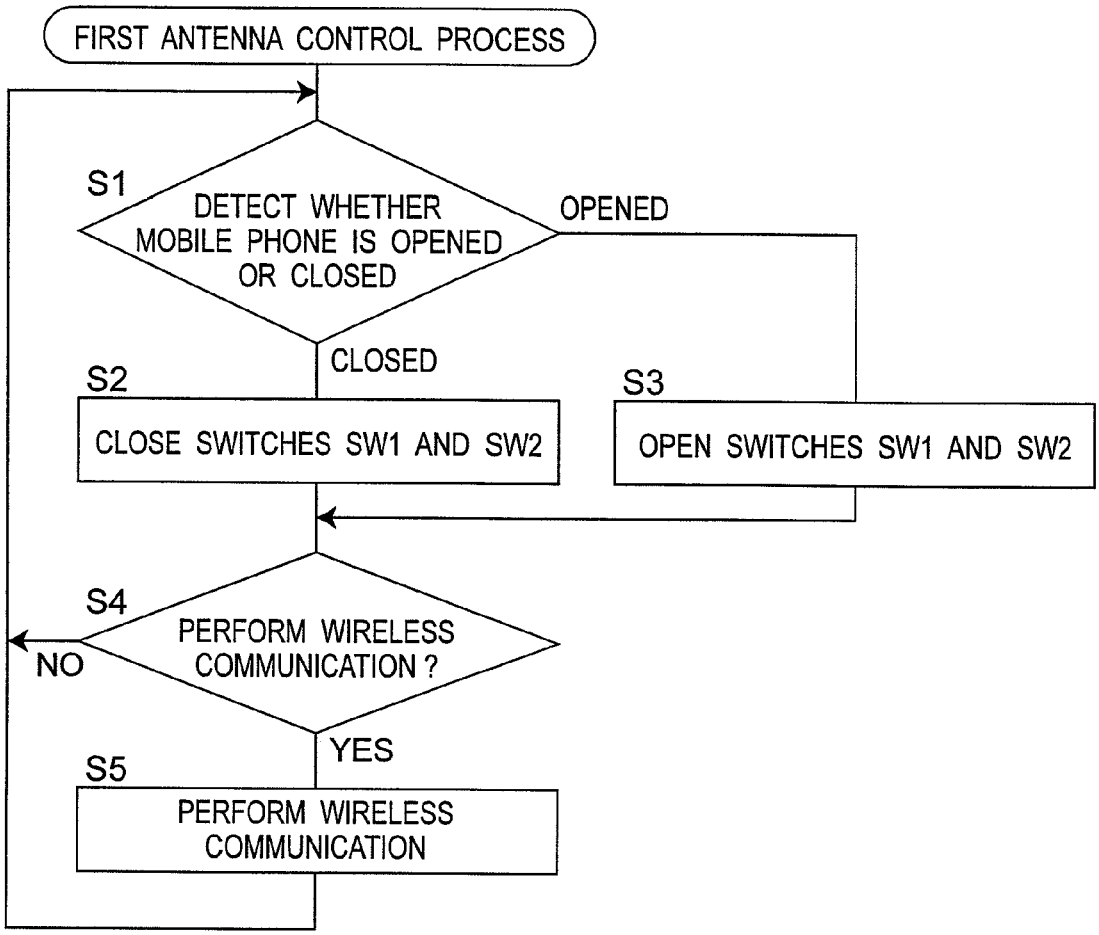
FIG. 8 is a flowchart showing a first antenna control process performed by a controller 16 of the antenna apparatus of FIGS. 1A and 1B.

FIG. 8 is a flowchart showing a first antenna control process performed by a controller 16 of the antenna apparatus of FIGS. 1A and 1B. For simplification, the antenna control process in FIG. 8 only includes the control of the switches SW1 and SW2. In step S1, the controller 16 detects whether the mobile phone is opened or closed, based on an open and close detection signal from the open and close detector 15. If the mobile phone is closed, then the process goes to step S2; and if the mobile phone is opened, then the process goes to step S3. In step S2, the controller 16 closes the switches SW1 and SW2, and then goes to step S4. In step S3, the controller 16 opens the switches SW1 and SW2, and then goes to step S4. In step S4, the controller 16 determines whether or not to perform wireless communication. If YES, then the process goes to step S5; and if NO, then the process returns to step S1. In step S5, the controller 16 controls the wireless communication circuits 12 and 14 to perform wireless communication, and returns to step S1.

Figure 9:
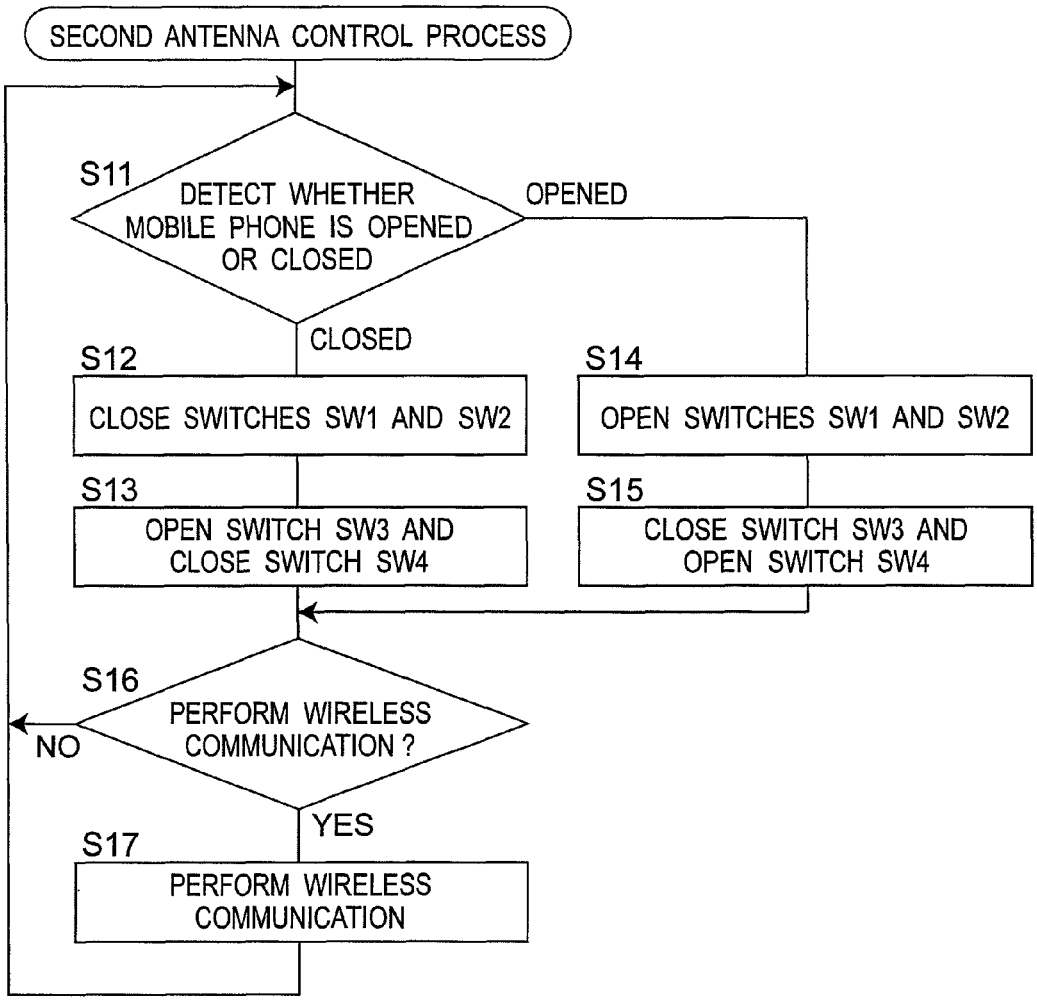
FIG. 9 is a flowchart showing a second antenna control process performed by the controller 16 of the antenna apparatus of FIGS. 1B and 1B.

FIG. 9 is a flowchart showing a second antenna control process performed by the controller 16 of the antenna apparatus of FIGS. 1A and 1B. The antenna control process in FIG. 9 also includes the control of the switches SW3 and SW4, in addition to the process in FIG. 8. In step S11, the controller 16 detects whether the mobile phone is opened or closed, based on an open and close detection signal from the open and close detector 15. If the mobile phone is closed, then the process goes to step S12; and if the mobile phone is opened, then the process goes to step S14. In step S12, the controller 16 closes the switches SW1 and SW2, and then in step S13, the controller 16 opens the switch SW3 and closes the switch SW4, and then goes to step S16. In step S14, the controller 16 opens the switches SW1 and SW2, and then in step S15, the controller 16 closes the switch SW3 and opens the switch SW4, and then goes to step S16. In step S16, the controller 16 determines whether or not to perform wireless communication. If YES, then the process goes to step S17; and if NO, then the process returns to step S11. In step S17, the controller 16 controls the wireless communication circuits 12 and 14 to perform wireless communication, and returns to step S11.

As preferred modified embodiments, the antenna elements 1 and 2 and the ground conductor 3 are not limited to rectangular, and may be, for example, polygon or other forms including curves. Moreover, the antenna elements 1 and 2 are not limited to be provided within the upper housing 101 of the mobile phone as shown in FIGS. 2A and 2B, and the antenna elements 1 and 2 may be provided outside the upper housing 101, or may be integrated with the upper housing 101. The same also applies to the ground conductor 3 that is shown in FIGS. 2A and 2B as provided within the lower housing 102. Further, the orientation of the slit S is not limited to that in parallel to the longitudinal direction of the mobile phone as shown in FIGS. 2A and 2B, and the slit S may be provided with a certain oblique angle with respect to the longitudinal direction of the mobile phone. Furthermore, the slit S is not limited to linear, and the slit S may include a curved portion(s).

Instead of the switches SW1 and SW2 being electrically opened and closed under control of the controller 16, the switches SW1 and SW2 may be mechanically opened and closed in response to the opening and closing of the housing of the mobile phone.

The position of the switch SW3 is not limited to an end of the parasitic slit S remote from the ground conductor 3 when the antenna apparatus is opened, and may be a certain position between the end and the center in the longitudinal direction of the parasitic slit S. Similarly, the position of the switch SW4 is not limited to an end of the parasitic slit S opposed to the ground conductor 3 when the antenna apparatus is opened, and may be a certain position between the end and the center in the longitudinal direction of the parasitic slit S.

The antenna elements 1 and 2 are electrically connected to the ground conductor 3 through the short-circuit conductors 4*a*, 4*b*, 5*a*, and 5*b*, when the antenna apparatus is closed. Accordingly, in some type of antenna apparatuses (e.g., an antenna apparatus with a configuration in which the short-circuit conductors 4*a* and 5*a* are close to an end of the parasitic slit S), the slit S may configure a one-end open parasitic slit without closing the switches SW3 and SW4. Furthermore, when the antenna apparatus is closed, the slit S may configure a slot by closing both the switches SW3 and SW4. In this case, since the resonant frequency of the slot is higher than the resonant frequency of the antenna elements 1 and 2, the operating frequency of the antenna apparatus can be shifted to a higher frequency. Moreover, since the antenna elements 1 and 2 are electrically connected to the ground conductor 3 through the short-circuit conductors 4*a*, 4*b*, 5*a*, and 5*b* when the antenna apparatus is closed, the slit S may configure a slot by closing only the switch SW3 without closing the switch SW4 in some type of antenna apparatuses.

Furthermore, the wireless communication circuits 12 and 14 may be configured to perform modulation and demodulation of two independent radio signals, instead of performing MIMO communication. In this case, the antenna apparatus according to the present preferred embodiment can simultaneously perform wireless communications for multiple applications, or simultaneously perform wireless communications in multiple frequency bands.

As described above, the antenna apparatus and the mobile phone according to the present preferred embodiment can transmit or receive regardless of whether the antenna apparatus is opened or closed, and further, can simultaneously transmit or receive two radio signals with low correlations to each other.

Preferred modified embodiments of the present preferred embodiment will be further described below with reference to FIGS. 10A to 19.

Figure 10A:
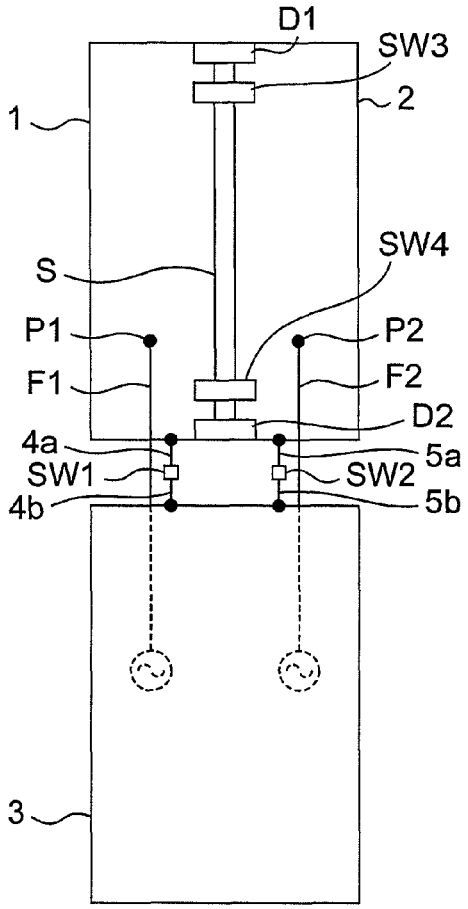
FIG. 10A is a schematic diagram showing an antenna apparatus in its open state, according to a first preferred modified embodiment of the first preferred embodiment of the present invention.
Figure 10B:
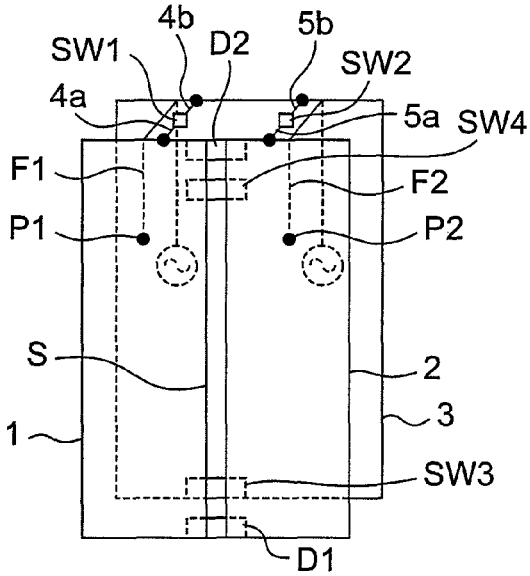
FIG. 10B is a schematic diagram showing the antenna apparatus of FIG. 10A in its closed state.
Figure 11:
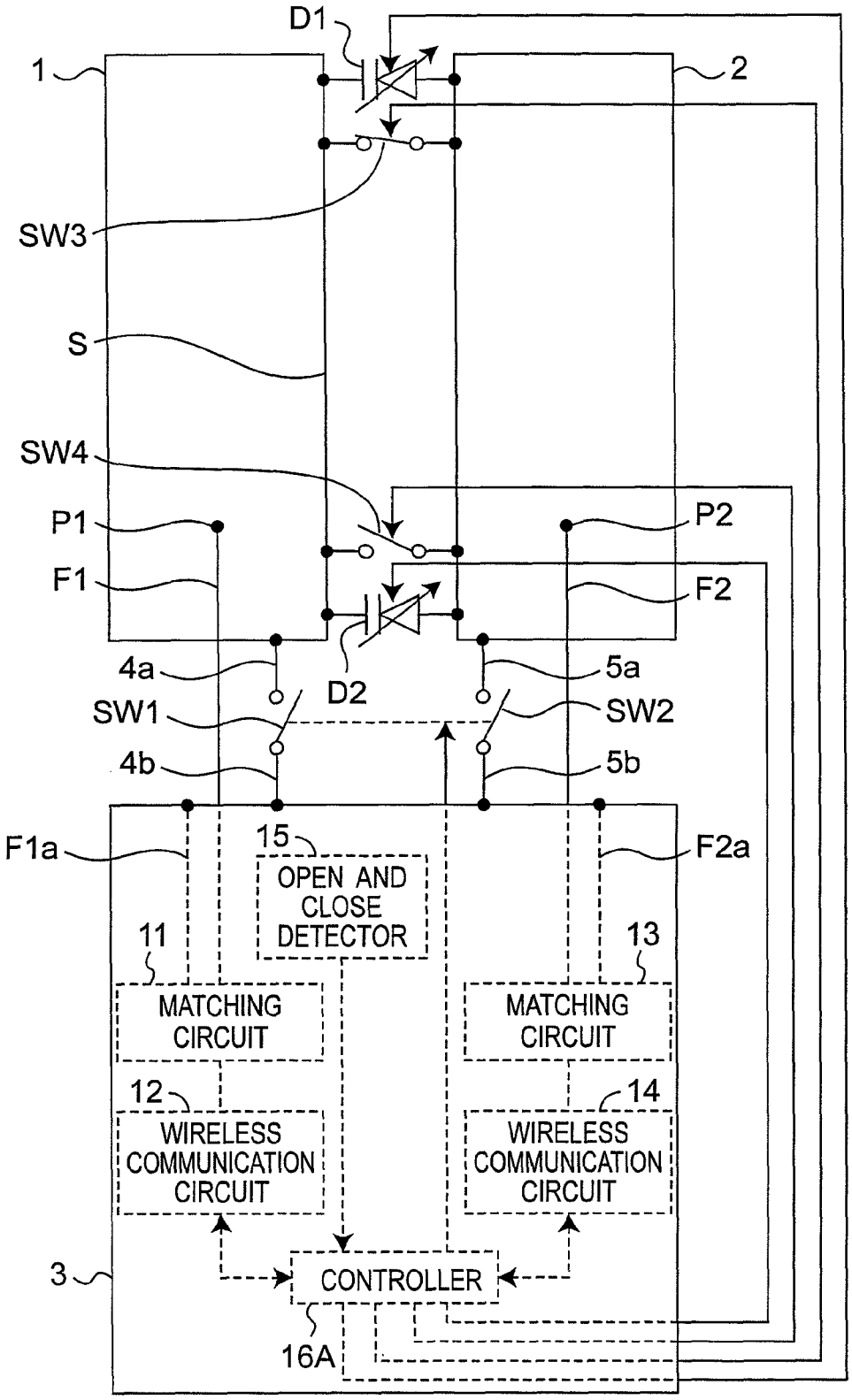
FIG. 11 is a block diagram showing a circuit configuration of the antenna apparatus of FIG. 10A in its open state.
Figure 12:
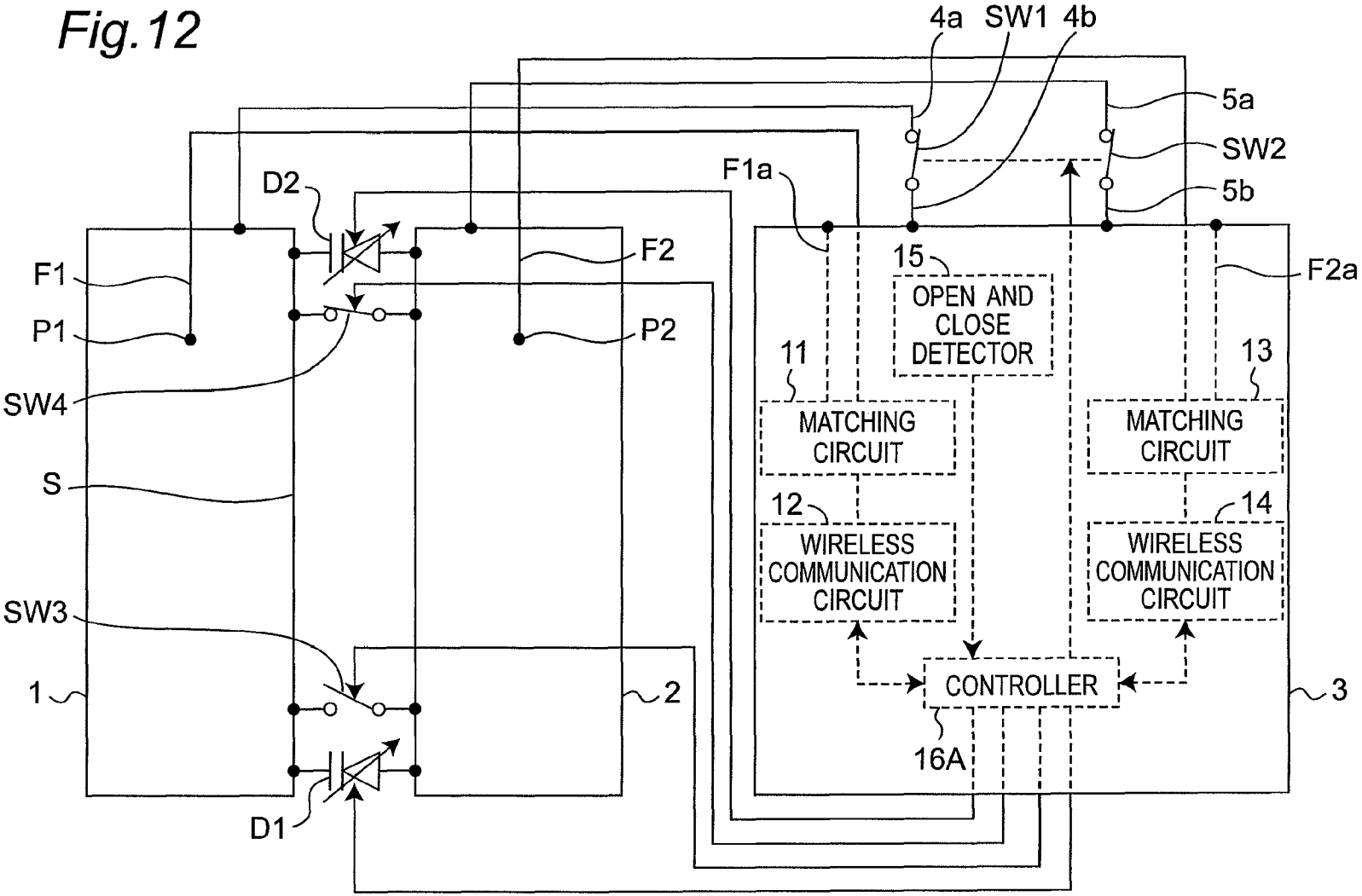
FIG. 12 is a block diagram showing a circuit configuration of the antenna apparatus of FIG. 10B in its closed state.

FIG. 10A is a schematic diagram showing an antenna apparatus in its open state, according to a first preferred modified embodiment of the first preferred embodiment of the present invention. FIG. 10B is a schematic diagram showing the antenna apparatus of FIG. 10A in its closed state. FIG. 11 is a block diagram showing a circuit configuration of the antenna apparatus of FIG. 10A in its open state. FIG. 12 is a block diagram showing a circuit configuration of the antenna apparatus of FIG. 10B in its closed state. The antenna apparatus of FIG. 10 is characterized by including, in addition to the configuration shown in FIG. 1, variable capacitance diodes D1 and D2 for adjusting a substantial electrical length of a parasitic slit S to obtain a desired resonant frequency. The variable capacitance diode D1 is connected across antenna elements 1 and 2, so as to be close to a switch SW3 along the parasitic slit S and to be located outer than the switch SW3 along the parasitic slit S. Similarly, the variable capacitance diode D2 is connected across the antenna elements 1 and 2, so as to be close to a switch SW4 along the parasitic slit S and to be located outer than the switch SW4 along the parasitic slit S. As shown in FIGS. 11 and 12, the antenna apparatus includes, instead of the controller 16 in FIGS. 4 and 5, a controller 16A that is configured to compute and control voltages applied to the variable capacitance diodes D1 and D2 so as to change the capacitance values (or reactance values) of the variable capacitance diodes D1 and D2, and that performs an antenna control process shown in FIG. 15.

In the case that the shape of the parasitic slit S is fixed, the resonant frequency of the parasitic slit S cannot be changed. Therefore, when a difference between a resonant frequency, at which the antenna elements 1 and 2 are respectively excited through feeding points P1 and P2, and a resonant frequency of the parasitic slit S has increased with a change in communication frequency, the degree of coupling decreases between the antenna elements 1 and 2 and the parasitic slit S, thus resulting in difficulty in adjusting the resonant frequency. The controller 16A according to the present preferred modified embodiment controls voltages applied to the variable capacitance diodes D1 and D2 so as to change the capacitance values (or reactance values) of the variable capacitance diodes D1 and D2, thus adjusting the substantial electrical length of the parasitic slit S to obtain a desired resonant frequency. Specifically, while the controller 16A controls each of wireless communication circuits 12 and 14 to transmit a test signal of a desired frequency, the controller 16A changes voltages applied to the variable capacitance diodes D1 and D2, and monitors reflection coefficients (which may be Voltage Standing Wave Ratio (VSWR) or reflector power) at the feeding points P1 and P2. The controller 16A adaptively computes applied voltage values so as to minimize the reflection coefficients, and sets the computed applied voltage values for the variable capacitance diodes D1 and D2. The controller 16A controls only the variable capacitance diode D2 when the antenna apparatus is opened, and controls only the variable capacitance diode D1 when the antenna apparatus is closed. Since the variable capacitance diodes D1 and D2 are provided outer than the switches SW3 and SW4 along the parasitic slit S, the variable capacitance diodes D1 and D2 are effective only when the switches SW3 and SW4 are opened. When the antenna apparatus is opened and thus the switch SW3 is closed, the variable capacitance diode D1 does not substantially affect the electrical length of the parasitic slit S. When the antenna apparatus is closed and thus the switch SW4 is closed, the variable capacitance diode D2 does not substantially affect the electrical length of the parasitic slit S. Accordingly, even when a difference between a resonant frequency, at which the antenna elements 1 and 2 are respectively excited through the feeding points P1 and P2, and a resonant frequency of the parasitic slit S becomes large with a change in communication frequency, the electrical length of the parasitic slit S can be substantially changed according to the change in communication frequency, thus improving the degree of coupling between the antenna elements 1 and 2 and the parasitic slit S, and appropriately adjusting the resonant frequency.

Figure 13A:
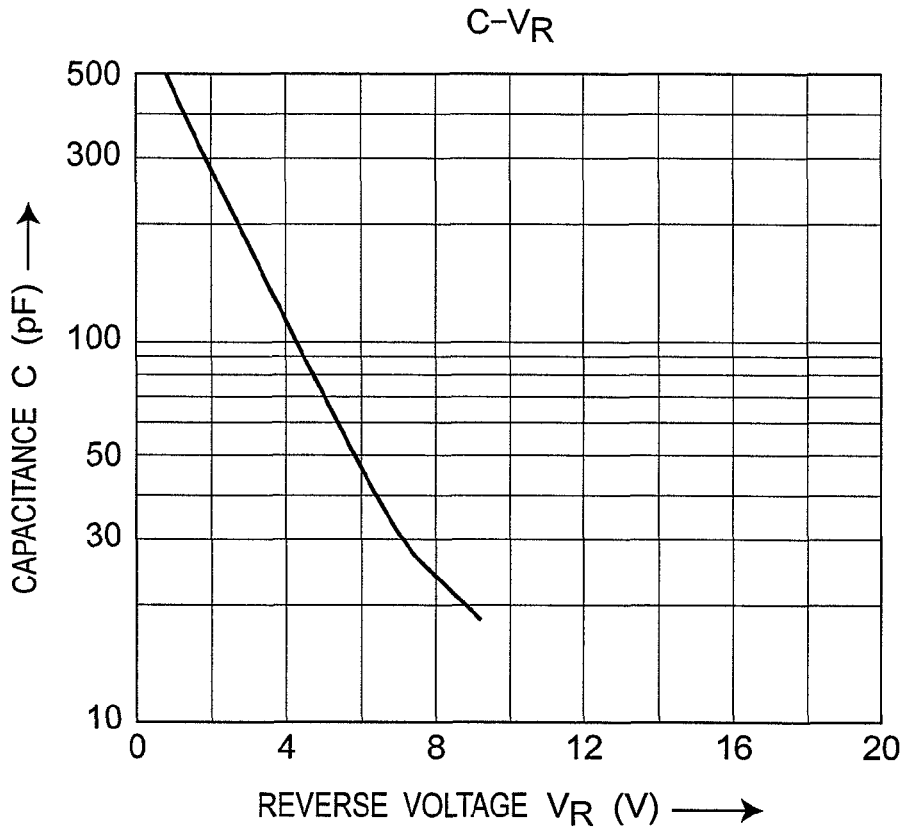
FIG. 13A is a graph showing a change in capacitance C versus a reverse voltage $V_R$ applied to a variable capacitance diode.
Figure 13B:
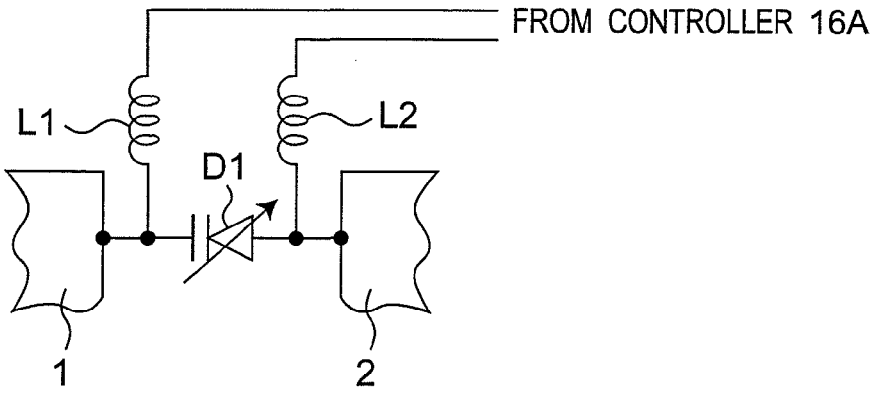
FIG. 13B is a circuit diagram showing a detailed configuration of a variable capacitance diode D1 in FIGS. 10A and 10B.

FIG. 13A is a graph showing a change in capacitance C versus a reverse voltage $V_R$ applied to a variable capacitance diode. FIG. 13B is a circuit diagram showing a detailed configuration of a variable capacitance diode D1 in FIGS. 10A and 10B. As shown in FIG. 13B, the variable capacitance diode D1 is connected across the antenna elements 1 and 2, and both ends of the variable capacitance diode D1 are connected to the controller 16A through control lines which preferably include radio frequency choke inductors L1 and L2, respectively. The variable capacitance diode D2 is also connected to the controller 16A in the same manner as shown in FIG. 13B. Generally, an impedance Z of a capacitance element with a capacitance value C for an angular frequency ω is represented by $Z=1/(j\omega C)$. When the capacitance value C is sufficiently large, the impedance becomes substantially zero, and thus, the capacitance element is substantially short-circuited. On the other hand, when the capacitance value C is sufficiently small, the impedance becomes substantially infinite, and thus, the capacitance element is substantially opened. As a type of variable capacitance element, there is a variable capacitance diode (varactor diode). The variable capacitance diode has such characteristics that the capacitance value C decreases by increasing a reverse voltage $V_R$ to be applied, and the capacitance value C increases by reducing the reverse voltage $V_R$, as shown in FIG. 13A. Thus, the variable capacitance diode can become either of a short-circuited state, a capacitance element, or an open state, according to a reverse voltage value $V_R$ to be applied. As an alternative variable capacitance element, a MEMS (Micro Electro Mechanical Systems) element may be used. The MEMS element determines a capacitance value C by mechanical operation, and thus can change the capacitance value C over a wider range than the variable capacitance diode. Furthermore, when using variable capacitance elements with capacitance ranging from a capacitance value (or reactance value) considered to be open to a capacitance value (or reactance value) considered to be short-circuited, the variable capacitance elements can also operate as the switches SW3 and SW4, in addition to changing the electrical length of the parasitic slit S by adjusting the capacitance values or reactance values, as will be described in detail below with reference to FIGS. 18A, 18B, and 19.

Figure 14A:
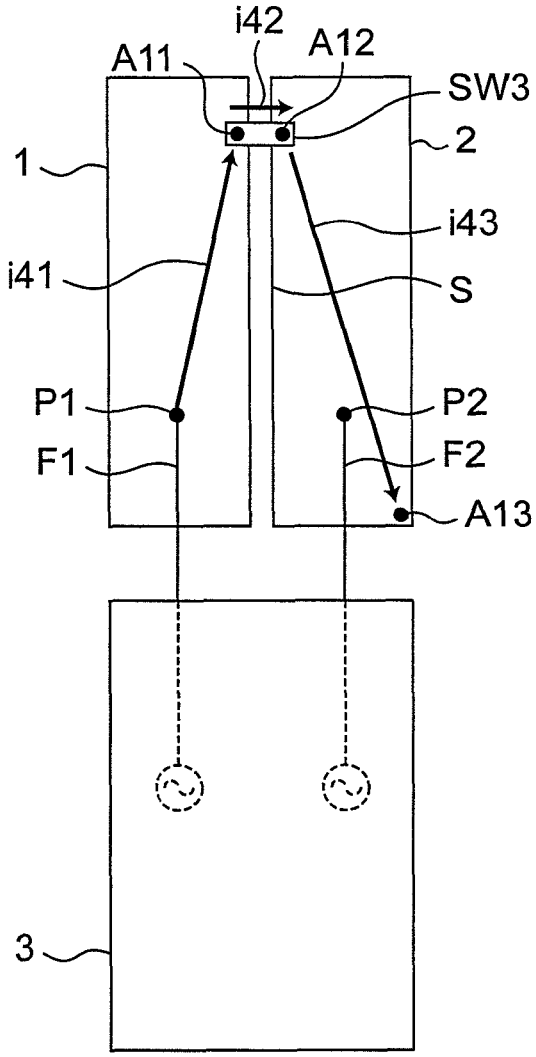
FIG. 14A is a schematic diagram showing a current path for when a switch SW3 is closed in the antenna apparatus of FIG. 10A.
Figure 14B:
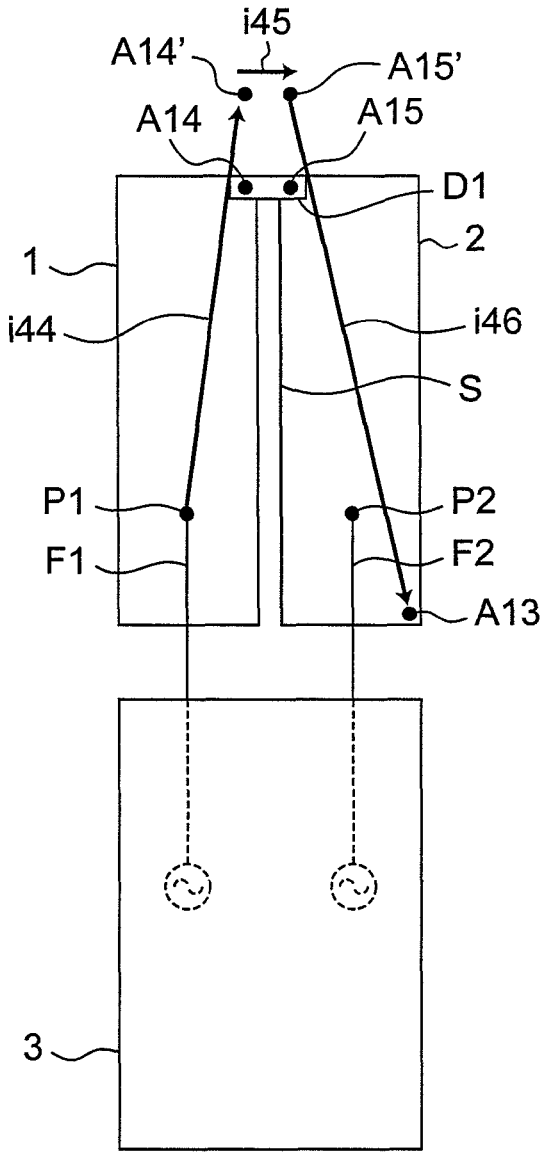
FIG. 14B is a schematic diagram showing a current path for when the switch SW3 of FIG. 14A is opened.

FIG. 14A is a schematic diagram showing a current path for when a switch SW3 is closed in the antenna apparatus of FIG. 10A. FIG. 14B is a schematic diagram showing a current path for when the switch SW3 of FIG. 14A is opened. For ease of explanation, in FIG. 14A, switches SW1, SW2, and SW4, short-circuit conductors 4*a*, 4*b*, 5*a*, and 5*b*, and the variable capacitance diodes D1 and D2 are omitted, and in FIG. 14B, the switches SW1, SW2, SW3, and SW4, the short-circuit conductors 4*a*, 4*b*, 5*a*, and 5*b*, and the variable capacitance diode D2 are omitted. In addition, FIG. 14B shows the antenna apparatus in its open state without being folded. When the switch SW3 is closed as shown in FIG. 14A, a radio-frequency current arriving at the feeding point P1 through a feeding line F1 flows toward the switch SW3 from the feeding point P1 (current i41), passes through the switch SW3 from a point A11 on the antenna element 1 to a point A12 on the antenna element 2 (current i42), and then, flows toward a point A13 on the antenna element 2 most remote from the switch SW3 (current i43), as described with reference to FIG. 6B. In this case, when the switch SW3 is opened, the substantial electrical length of the parasitic slit S changes due to the effect of the variable capacitance diode D1, and accordingly, the parasitic slit S extends beyond points A14 and A15 at the actual position of the switch SW3, i.e., at a closed end of the parasitic slit S, and substantially extends to virtual points A14' and A15' that are moved from the points A14 and A15. When increasing the capacitance value of the variable capacitance diode D1, the electrical length of the parasitic slit S increases as shown in FIG. 14B. Accordingly, in the case of FIG. 14B, a current substantially flows toward the point A14' from the feeding point P1 (current i44), flows from the point A14' to the point A15' (current i45), and then flows toward the point A13 (current i46). The current flows around the parasitic slit S in the above described manner, and accordingly, when changing the electrical length of the parasitic slit S by adjusting the capacitance value of the variable capacitance diode D1 connected to the parasitic slit S, the path of a current flowing around the parasitic slit S also virtually changes, and the resonant frequency of the antenna apparatus changes. Thus, when the switch SW3 is opened and a current passes through the variable capacitance diode D1, it is possible to substantially change the electrical length of the parasitic slit S according to the change in communication frequency, and change the lengths of current paths of radio-frequency currents fed to the antenna elements 1 and 2. Therefore, it is possible to improve the degree of coupling between the antenna elements 1 and 2 and the parasitic slit S, and appropriately adjust the resonant frequency. Similarly, when the switch SW4 is opened and a current passes through the variable capacitance diode D2, and when the antenna apparatus is operated in its closed state, it is possible to improve the degree of coupling between the antenna elements 1 and 2 and the parasitic slit S, and appropriately adjust the resonant frequency.

Figure 15:
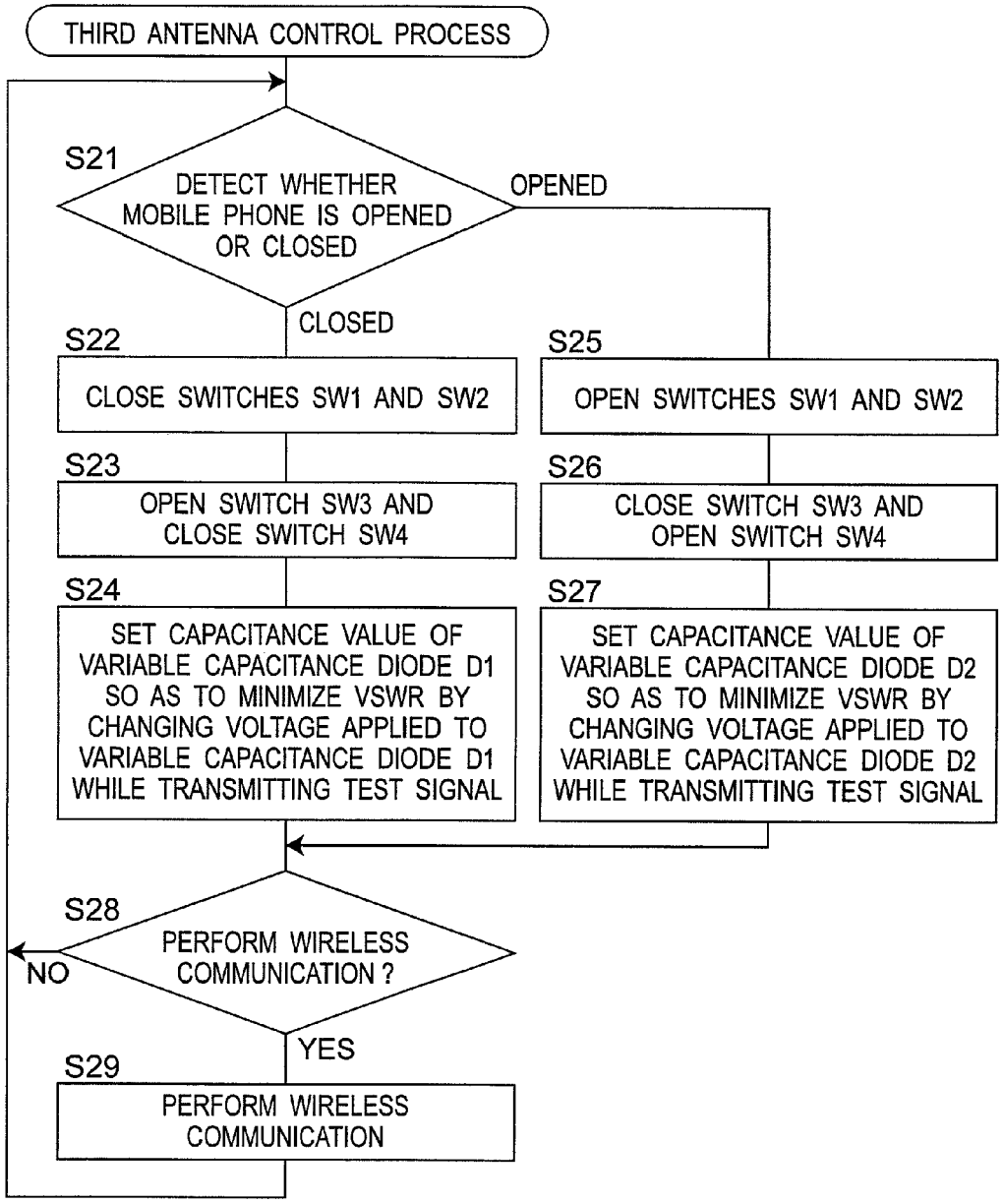
FIG. 15 is a flowchart showing a third antenna control process performed by a controller 16A of the antenna apparatus of FIGS. 10A and 10B.

FIG. 15 is a flowchart showing a third antenna control process performed by the controller 16A of the antenna apparatus of FIGS. 10A and 10B. In step S21, the controller 16A detects whether the mobile phone is opened or closed, based on an open and close detection signal from an open and close detector 15. If the mobile phone is closed, then the process goes to step S22; and if the mobile phone is opened, then the process goes to step S25. In step S22, the controller 16A closes the switches SW1 and SW2, and then in step S23, the controller 16A opens the switch SW3 and closes the switch SW4, and then goes to step S24. In step S24, the controller 16A sets the capacitance value of the variable capacitance diode D1 so as to minimize VSWR by changing a voltage applied to the variable capacitance diode D1 while transmitting a test signal, and then goes to step S28. In step S25, the controller 16A opens the switches SW1 and SW2, and then in step S26, the controller 16A closes the switch SW3 and opens the switch SW4, and then goes to step S27. In step S27, the controller 16A sets the capacitance value of the variable capacitance diode D2 so as to minimize VSWR by changing a voltage applied to the variable capacitance diode D2 while transmitting a test signal, and then goes to step S28. In step S28, the controller 16A determines whether or not to perform wireless communication. If YES, then the process goes to step S29; and if NO, then the process return to step S21. In step S29, the controller 16A controls wireless communication circuits 12 and 14 to perform wireless communication, and returns to step S21.

As a further modification for the first preferred modified embodiment of the present preferred embodiment described above, the variable capacitance diodes D1 and D2 are not limited to be respectively provided close to the switches SW3 and SW4 along the parasitic slit S and to be located outer than the switches SW3 and SW4 along the parasitic slit S, and the variable capacitance diodes D1 and D2 may be located at other preferable positions along the parasitic slit S. For example, since the variable capacitance diodes D1 and D2 can be provided at optimal positions along the parasitic slit S where the electric field strength increases, according to the open state or closed state of the antenna apparatus, it is possible to adjust the resonant frequency of the parasitic slit S by using a small capacitance value, and thus, reduce the sizes of variable capacitance diodes D1 and D2 to be used.

The controller 16A may monitor the reflection coefficients while transmitting a actual data signal to be communicated, instead of transmitting a test signal. Further, the controller 16A may compute an applied voltage value to be used upon reception, instead of by transmitting a test signal, by using a given mathematical expression (e.g., an expression for adding or subtracting a predetermined value based on a frequency difference between a transmitting frequency and a receiving frequency) based on an applied voltage value obtained upon transmission.

Figure 16A:
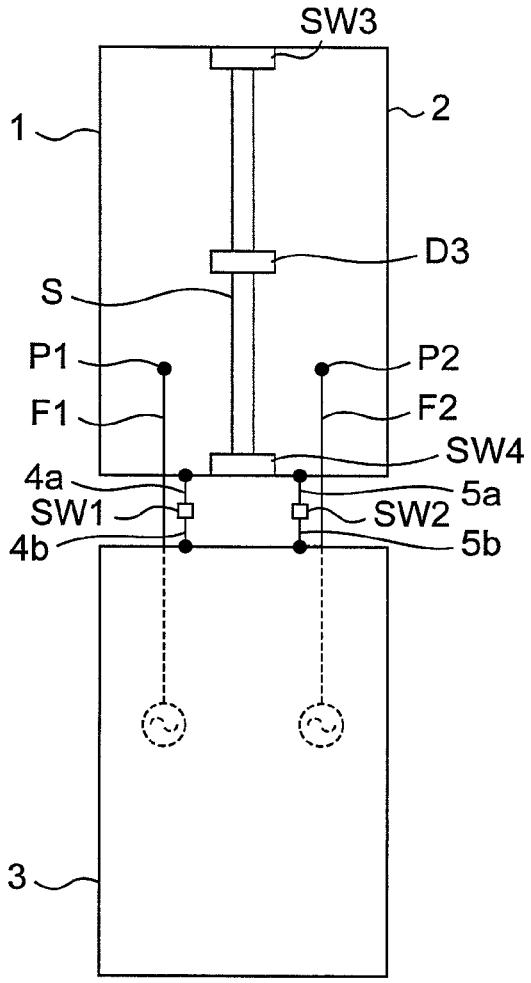
FIG. 16A is a schematic diagram showing an antenna apparatus in its open state, according to a second preferred modified embodiment of the first preferred embodiment of the present invention.
Figure 16B:
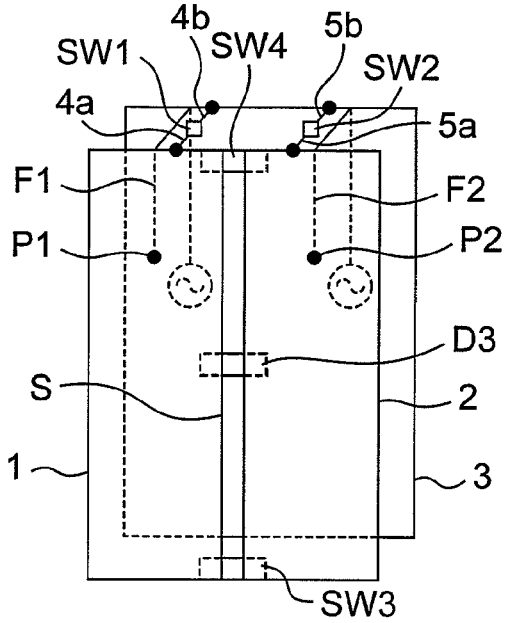
FIG. 16B is a schematic diagram showing the antenna apparatus in FIG. 16A in its closed state.

FIG. 16A is a schematic diagram showing an antenna apparatus in its open state, according to a second preferred modified embodiment of the first preferred embodiment of the present invention. FIG. 16B is a schematic diagram showing the antenna apparatus in FIG. 16A in its closed state. The present preferred modified embodiment is characterized by including, instead of two variable capacitance diodes D1 and D2 as in the first preferred modified embodiment, a single variable capacitance diode D3 at a certain position between switches SW3 and SW4 along a longitudinal direction of a parasitic slit S, preferably, substantially at the center in the longitudinal direction of the parasitic slit S. In the present preferred modified embodiment, since the variable capacitance diode D3 is located at a position less sensitive to the change in capacitance value as compared to the case of the first preferred modified embodiment, there is a need to provide a variable capacitance diode with a capacitance value changing over a wide range. A controller (not shown) of the present preferred modified embodiment controls a voltage applied to the variable capacitance diode D3 so as to change the capacitance value (or reactance value) of the variable capacitance diode D3. According to this configuration, the number of variable capacitance diodes is reduced to one, thus reducing the number of components and cost of the antenna apparatus, and simplifying an antenna control process.

Figure 17:
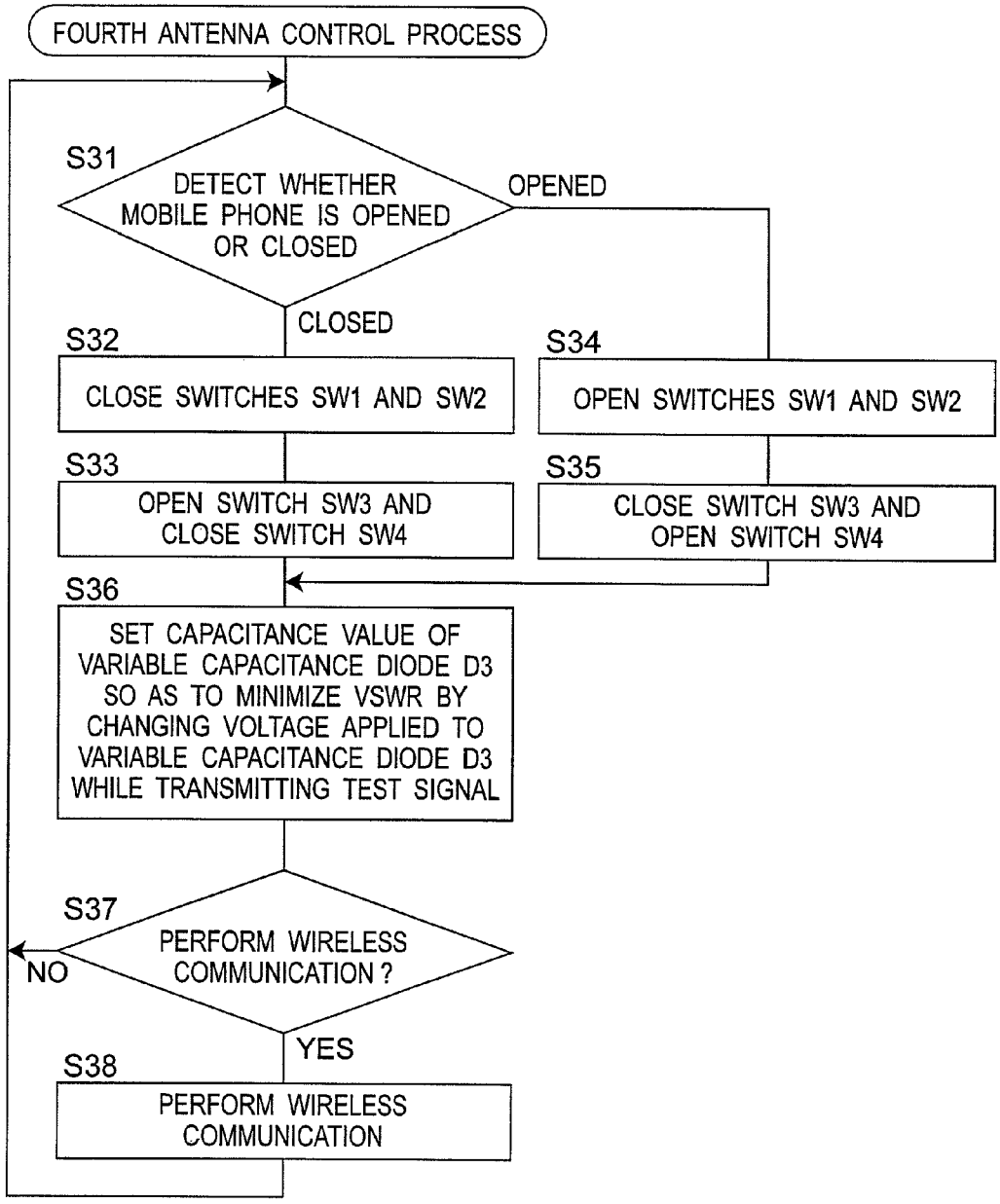
FIG. 17 is a flowchart showing a fourth antenna control process performed by a controller of the antenna apparatus of FIGS. 16A and 16B.

FIG. 17 is a flowchart showing a fourth antenna control process performed by the controller of the antenna apparatus of FIGS. 16A and 16B. In step S31, the controller detects whether the mobile phone is opened or closed, based on an open and close detection signal from an open and close detector 15. If the mobile phone is closed, then the process goes to step S32; and if the mobile phone is opened, then the process goes to step S34. In step S32, the controller closes switches SW1 and SW2, and then in step S33, the controller opens the switch SW3 and closes the switch SW4, and then goes to step S36. In step S34, the controller opens the switches SW1 and SW2, and then in step S35, the controller closes the switch SW3 and opens the switch SW4, and then goes to step S36. In step S36, the controller sets the capacitance value of the variable capacitance diode D3 so as to minimize VSWR by changing a voltage applied to the variable capacitance diode D3 while transmitting a test signal, and then goes to step S37.

In step S37, the controller determines whether or not to perform wireless communication. If YES, then the process goes to step S38; and if NO, then the process returns to step S31. In step S38, the controller controls wireless communication circuits 12 and 14 to perform wireless communication, and returns to step S31.

Figure 18A:
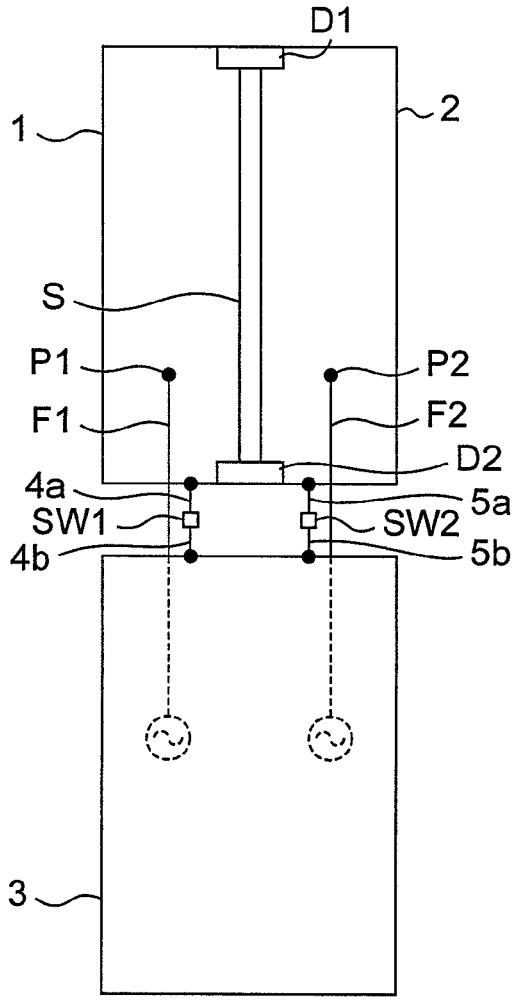
FIG. 18A is a schematic diagram showing an antenna apparatus in its open state, according to a third preferred modified embodiment of the first preferred embodiment of the present invention.
Figure 18B:
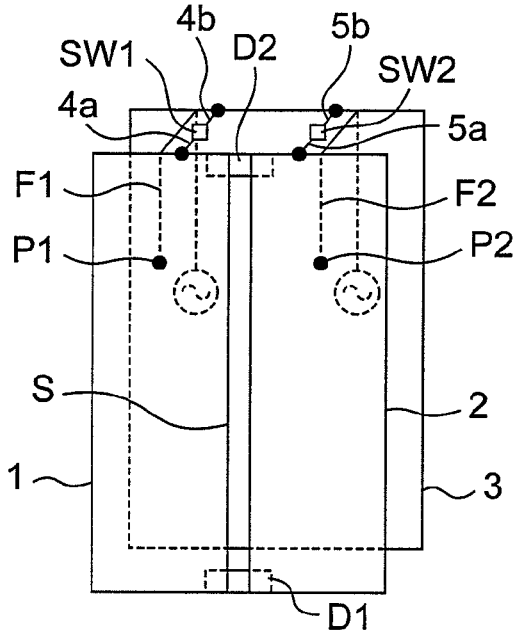
FIG. 18B is a schematic diagram showing the antenna apparatus of FIG. 18A in its closed state.

FIG. 18A is a schematic diagram showing an antenna apparatus in its open state, according to a third preferred modified embodiment of the first preferred embodiment of the present invention. FIG. 18B is a schematic diagram showing the antenna apparatus of FIG. 18A in its closed state. The present preferred modified embodiment is characterized by removing switches SW3 and SW4 from the configuration of the first preferred modified embodiment, and using variable capacitance diodes D1 and D2 to change the electrical length of a parasitic slit S by adjusting the capacitance values and further operate as the switches SW3 and SW4. The variable capacitance diodes D1 and D2 of the present preferred modified embodiment have variable capacitance ranging from a capacitance value considered to be open to a capacitance value considered to be short-circuited. A controller (not shown) of the present preferred modified embodiment controls voltages applied to the variable capacitance diodes D1 and D2 so as to change the capacitance values (or reactance values) of the variable capacitance diodes D1 and D2. According to this configuration, the switches SW3 and SW4 are removed from the antenna apparatus of FIG. 10, thus reducing the number of components and cost of the antenna apparatus.

Figure 19:
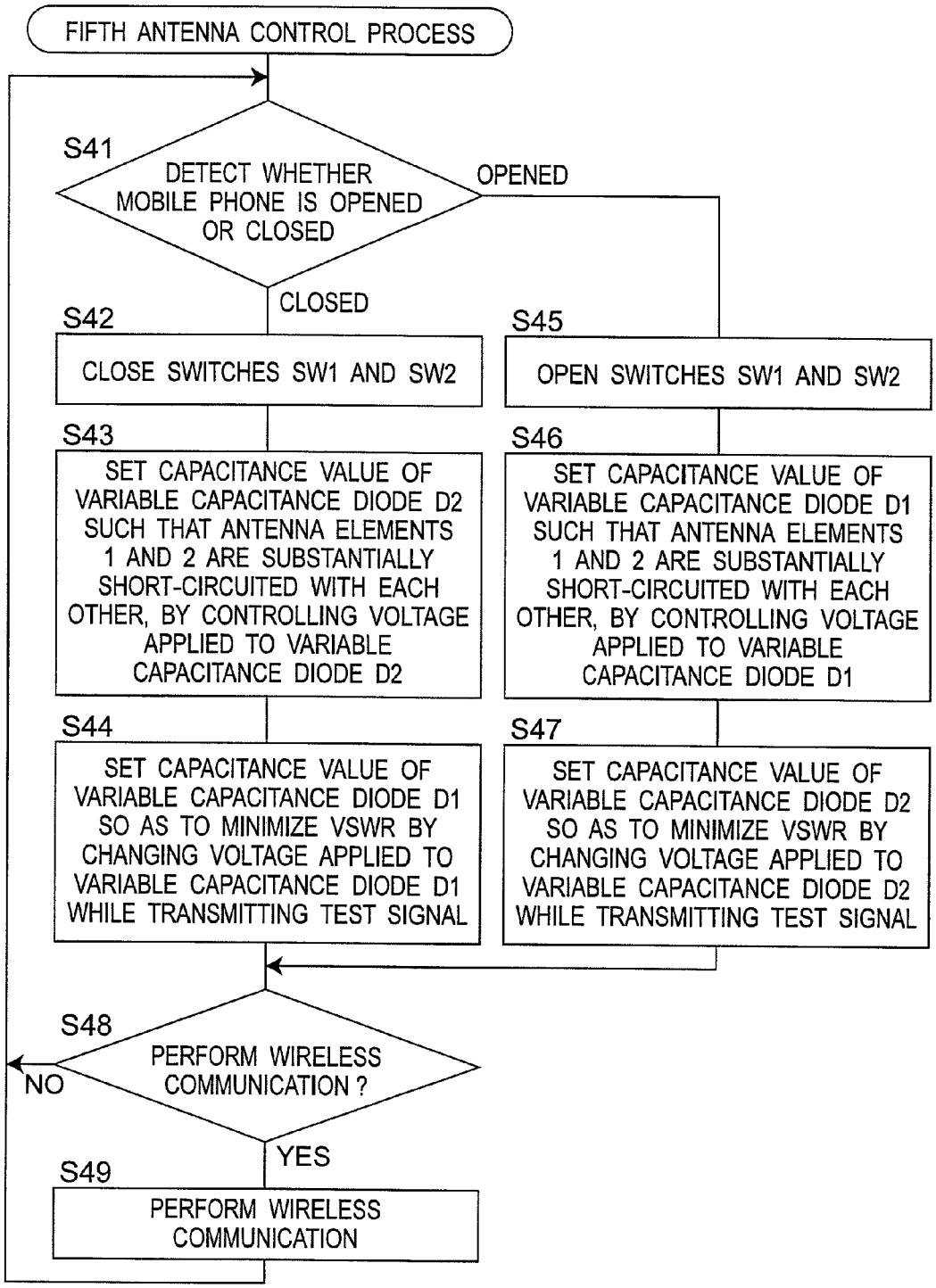
FIG. 19 is a flowchart showing a fifth antenna control process performed by a controller of the antenna apparatus of FIGS. 18A and 18B.

FIG. 19 is a flowchart showing a fifth antenna control process performed by the controller of the antenna apparatus of FIGS. 18A and 18B. In step S41, the controller detects whether the mobile phone is opened or closed, based on an open and close detection signal from an open and close detector 15. If the mobile phone is closed, then the process goes to step S42; and if the mobile phone is opened, then the process goes to step S45. In step S42, the controller closes switches SW1 and SW2, and then goes to step S43. In step S43, the controller sets the capacitance value of the variable capacitance diode D2 such that antenna elements 1 and 2 are substantially short-circuited with each other, by controlling a voltage applied to the variable capacitance diode D2, and then goes to step S44. In step S44, the controller sets the capacitance value of the variable capacitance diode D1 so as to minimize VSWR by changing a voltage applied to the variable capacitance diode D1 while transmitting a test signal, and then goes to step S48. In step S45, the controller opens the switches SW1 and SW2, and then goes to step S46. In step S46, the controller sets the capacitance value of the variable capacitance diode D1 such that the antenna elements 1 and 2 are substantially short-circuited with each other, by controlling a voltage applied to the variable capacitance diode D1, and then goes to step S47. In step S47, the controller sets the capacitance value of the variable capacitance diode D2 so as to minimize VSWR by changing a voltage applied to the variable capacitance diode D2 while transmitting a test signal, and then goes to step S48. In step S48, the controller determines whether or not to perform wireless communication. If YES, then the process goes to step S49; and if NO, then the process returns to step S41. In step S49, the controller controls wireless communication circuits 12 and 14 to perform wireless communication, and returns to step S41.

Second Preferred Embodiment

Figure 20A:
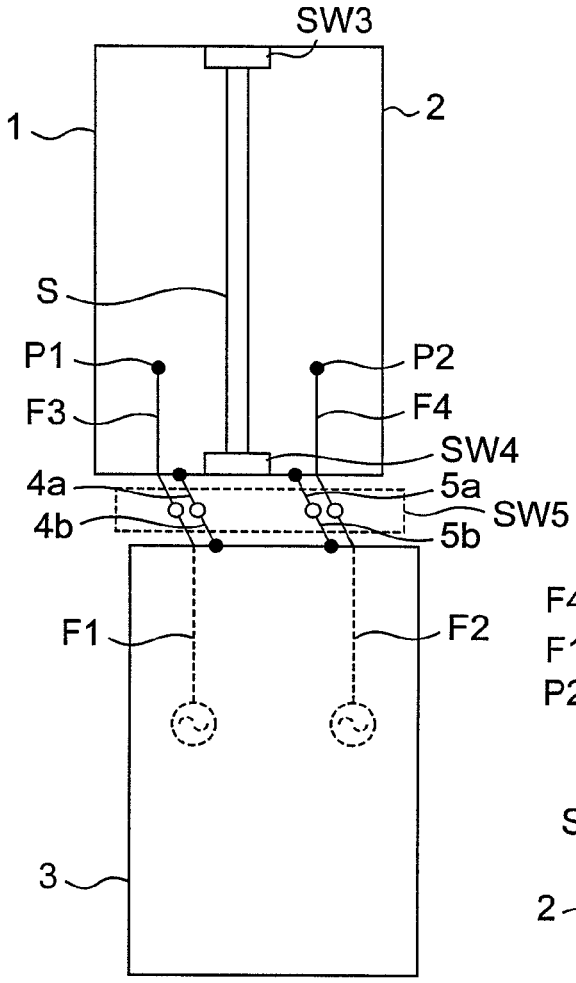
FIG. 20A is a schematic diagram showing an antenna apparatus in its open state, according to a second preferred embodiment of the present invention.
Figure 20B:
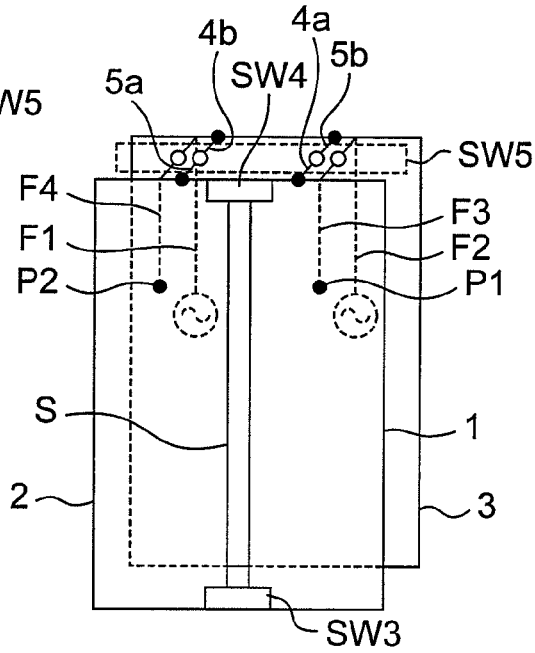
FIG. 20B is a schematic diagram showing the antenna apparatus in FIG. 20A in its closed state.
Figure 24:
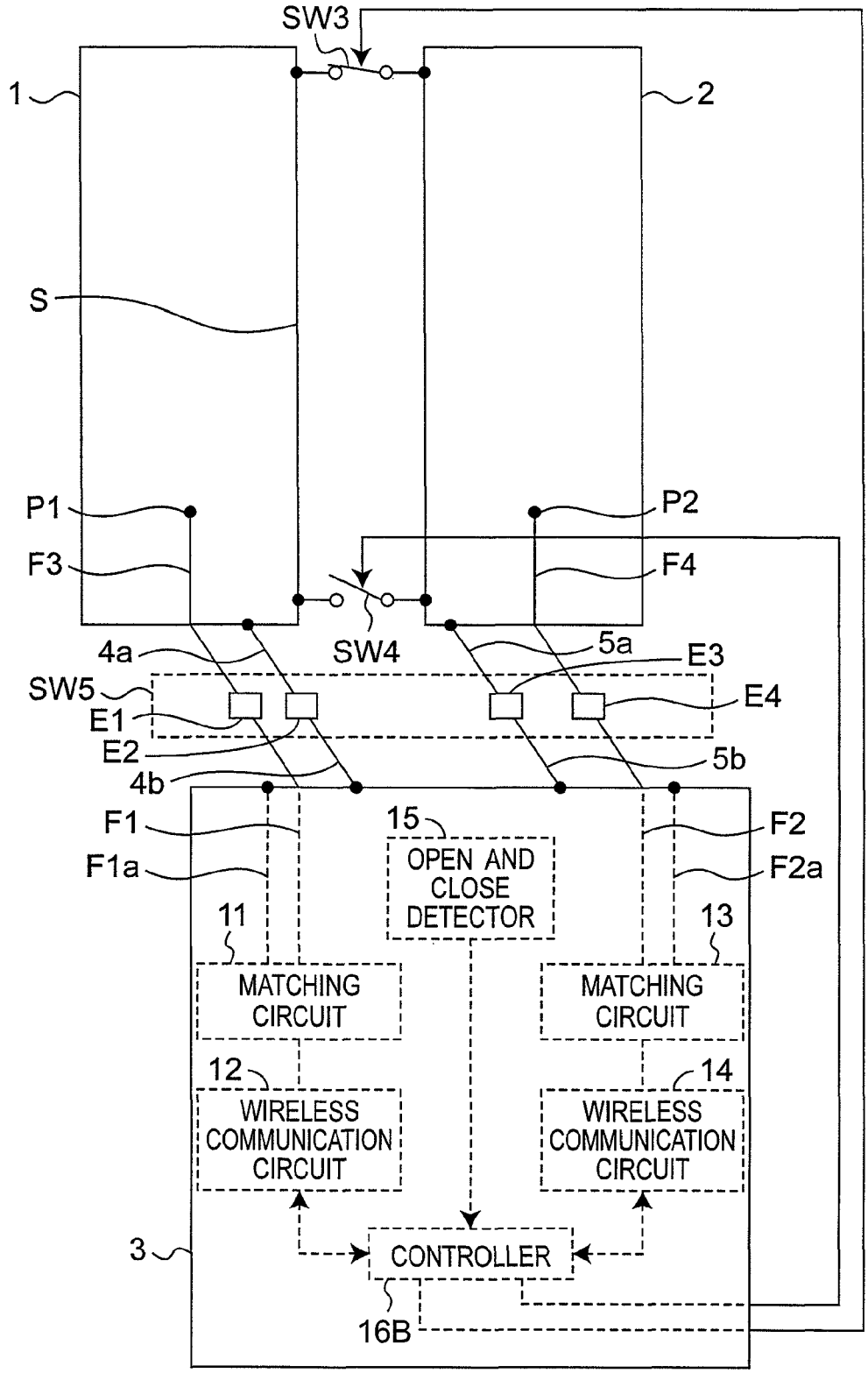
FIG. 24 is a block diagram showing a circuit configuration of the antenna apparatus of FIG. 20A in its open state.
Figure 25:
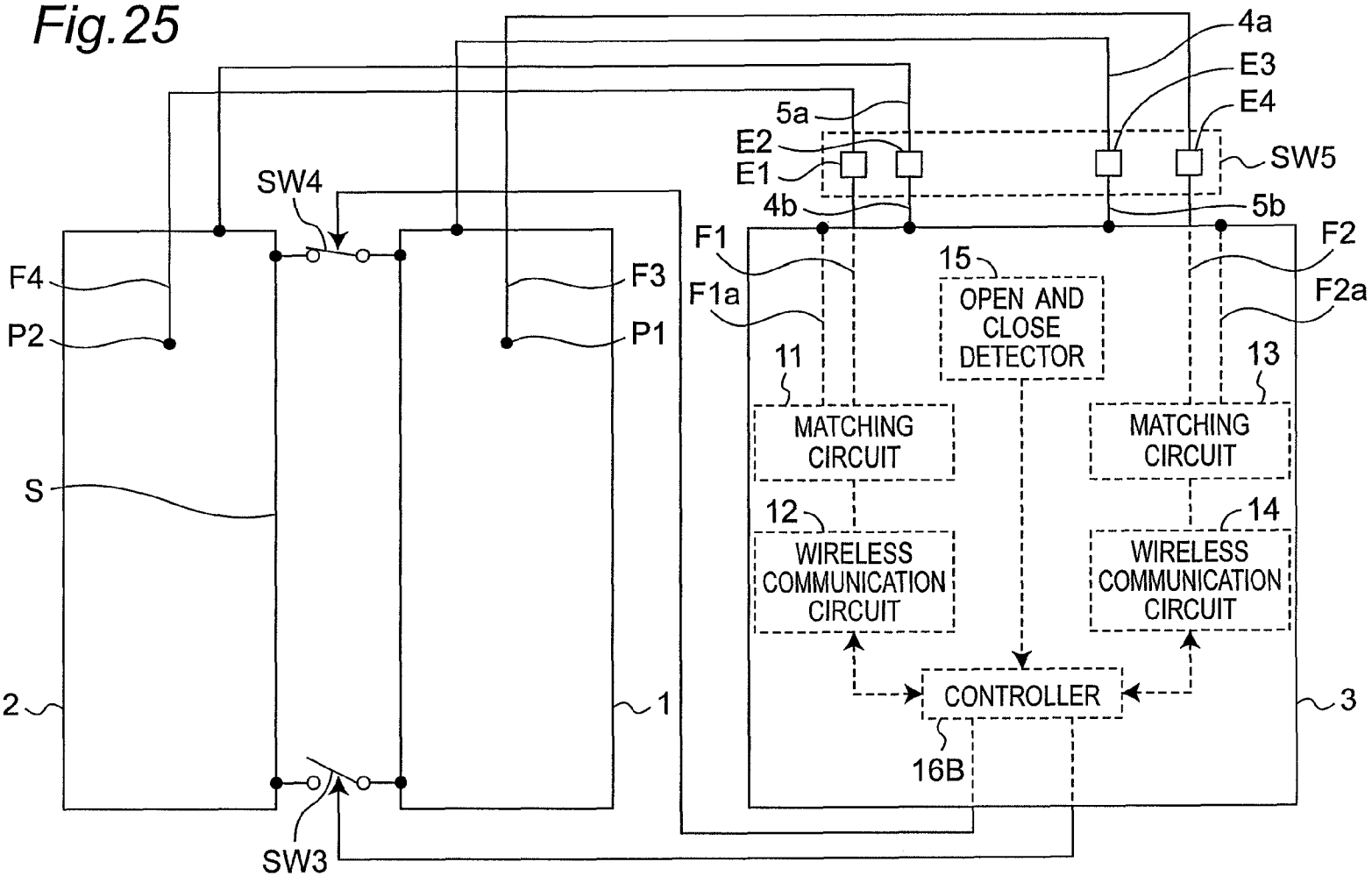
FIG. 25 is a block diagram showing a circuit configuration of the antenna apparatus of FIG. 20B in its closed state.

FIG. 20A is a schematic diagram showing an antenna apparatus in its open state, according to a second preferred embodiment of the present invention. FIG. 20B is a schematic diagram showing the antenna apparatus in FIG. 20A in its closed state. FIGS. 21A to 23B are schematic diagrams showing an implementation of a mobile phone provided with the antenna apparatus of FIGS. 20A and 20B. FIGS. 24 and 25 are block diagrams showing a circuit configuration of the antenna apparatus of FIGS. 20 and 20B. The antenna apparatus according to the present preferred embodiment is characterized by being opened and closed by rotation, in a manner similar to as that of the conventional mobile phone described with reference to FIG. 27, instead of being opened and closed in a two-fold similar to that of the antenna apparatus according to the first preferred embodiment.

Referring to FIG. 20A, antenna elements 1 and 2 made of conducting plates are provided in a first plane, and a ground conductor 3 made of a conducting plate is provided in second plane that is parallel to the first plane and spaced from the first plane by a certain distance. The antenna apparatus is closed as shown in FIG. 20B, by rotating the antenna elements 1 and 2 by 180 degrees with respect to the ground conductor 3 about a rotating shaft (not shown) vertical to the planes including the antenna elements 1 and 2 and the ground conductor 3 at a location where the antenna elements 1 and 2 are opposed to the ground conductor 3, When the antenna apparatus is closed, entire areas of the antenna elements 1 and 2 substantially overlaps an area of the ground conductor 3. A switch SW5 is provided at the location where the antenna elements 1 and 2 are opposed to the ground conductor 3 (i.e., a location near the rotating shaft), and the switch SW5 connects each of feeding points P1 and P2 to either of two radio-frequency circuits by mechanical operation, and changes between connection and disconnection of short-circuit conductors 4*a* and 5*a* and short-circuit conductors 4*b* and 5*b* by mechanical operation. Specifically, when the antenna apparatus is opened, the switch SW5 connects a feeding line F3 connected to the feeding point P1, to a feeding line F1 connected to a first radio-frequency circuit, and connects a feeding line F4 connected to the feeding point P2, to a feeding line F2 connected to a second radio-frequency circuit. When the antenna apparatus is opened, the switch SW5 further arranges the short-circuit conductors 4*a* and 4*b* to oppose to each other but not to make an electrical connection between them, and arranges the short-circuit conductors 5*a* and 5*b* to oppose to each other but not to make an electrical connection between them. On the other hand, when the antenna apparatus is closed, the switch SW5 connects the feeding line F3 to the feeding line F2, connects the feeding line F4 to the feeding line F1, connects the short-circuit conductor 4*a* to the short-circuit conductor 5*b*, and connects the short-circuit conductor 5*a* to the short-circuit conductor 4*b*.

When the antenna apparatus is opened as shown in FIG. 20A, the antenna element 1 and the ground conductor 3 operate as a dipole antenna by means of excitation through the feeding point P1, and similarly, the antenna element 2 and the ground conductor 3 also operate as a dipole antenna by means of excitation through the feeding point P2. Because of a parasitic slit S, the two dipole antennas operate with certain isolation therebetween. Furthermore, when the antenna apparatus is opened, a controller (not shown) of the antenna apparatus controls a switch SW3 to close and a switch SW4 to open along the parasitic slit S, and accordingly, a current path is formed that passes through the switch SW3 and extends over both the antenna elements 1 and 2, thus contributing to widening the bandwidth of the antenna apparatus. On the other hand, when the antenna apparatus is closed as shown in FIG. 20B, the antenna elements 1 and 2 are short-circuited to the ground conductor 3. Moreover, when the antenna apparatus is closed, the antenna element 1 operates as an inverted F antenna on the ground conductor 3 by means of excitation through the feeding lines F2 and F3 connected to the feeding point P1, and similarly, the antenna element 2 also operates as an inverted F antenna on the ground conductor 3 by means of excitation through the feeding lines F1 and F4 connected to the feeding point P2. Because of the parasitic slit S, the two inverted F antennas operate with certain isolation therebetween. Furthermore, when the antenna apparatus is closed, the controller of the antenna apparatus controls the switch SW3 to open and the switch SW4 to close, and accordingly, a current path is formed that passes through the switch SW4 and includes both the antenna elements 1 and 2, thus contributing to widening the bandwidth of the antenna apparatus.

Figure 21A:
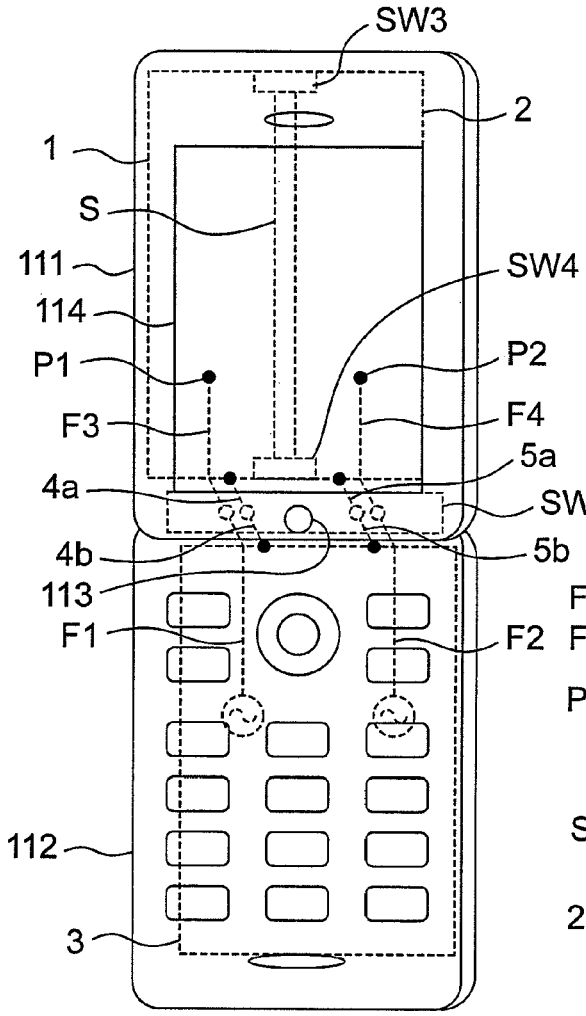
FIG. 21A is a schematic diagram showing an implementation of a mobile phone in its open state, provided with the antenna apparatus of FIG. 20A shown in phantom.
Figure 27A:
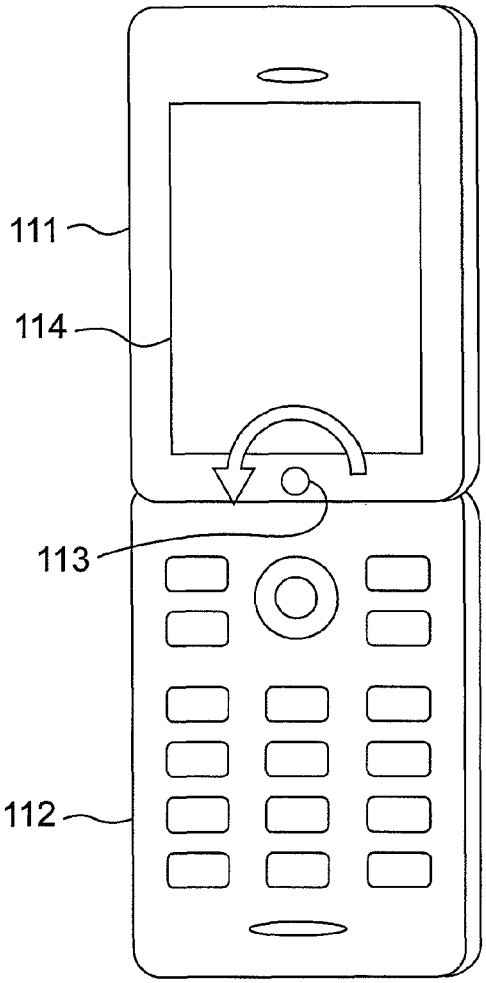
Fig.27A PRIOR ART
FIG. 27A is a diagram showing a conventional swivel mobile phone in its open state.
Figure 27B:
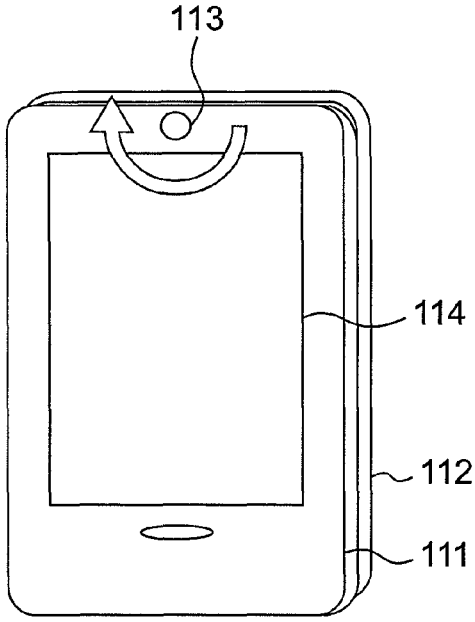
Fig.27B PRIOR ART
FIG. 27B is a diagram showing the swivel mobile phone of FIG. 27A in its closed state.

A housing of a mobile phone in FIGS. 21A to 23B is configured in the same manner as that of the conventional mobile phone described with reference to FIGS. 27A and 27B. FIG. 21A is a schematic diagram showing an implementation of a mobile phone in its open state, provided with the antenna apparatus of FIG. 20A shown in phantom. FIG. 21B is a schematic diagram showing the mobile phone of FIG. 21A in its closed state. The antenna elements 1 and 2 are provided within an upper housing 111 such that the parasitic slit S between the antenna elements 1 and 2 is parallel to a longitudinal direction of the mobile phone. The ground conductor 3 is provided within a lower housing 112. The upper housing 111 and the lower housing 112 are coupled to each other through a rotating shaft 113 that penetrates the upper housing 111 and the lower housing 112 in their thickness direction (or through an equivalent coupling mechanism). The mobile phone is opened and closed by rotation of the upper housing 111 about the rotating shaft 113. According to the opening and closing of the mobile phone, the antenna elements 1 and 2 are rotated by 180 degrees with respect to the ground conductor 3 about the rotating shaft 113 of the housing of the mobile phone.

Figure 21B:
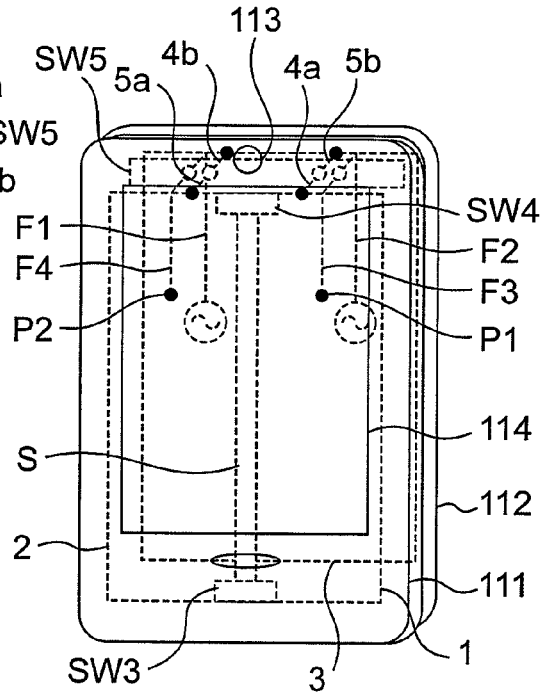
FIG. 21B is a schematic diagram showing the mobile phone of FIG. 21A in its closed state.
Figure 22A:
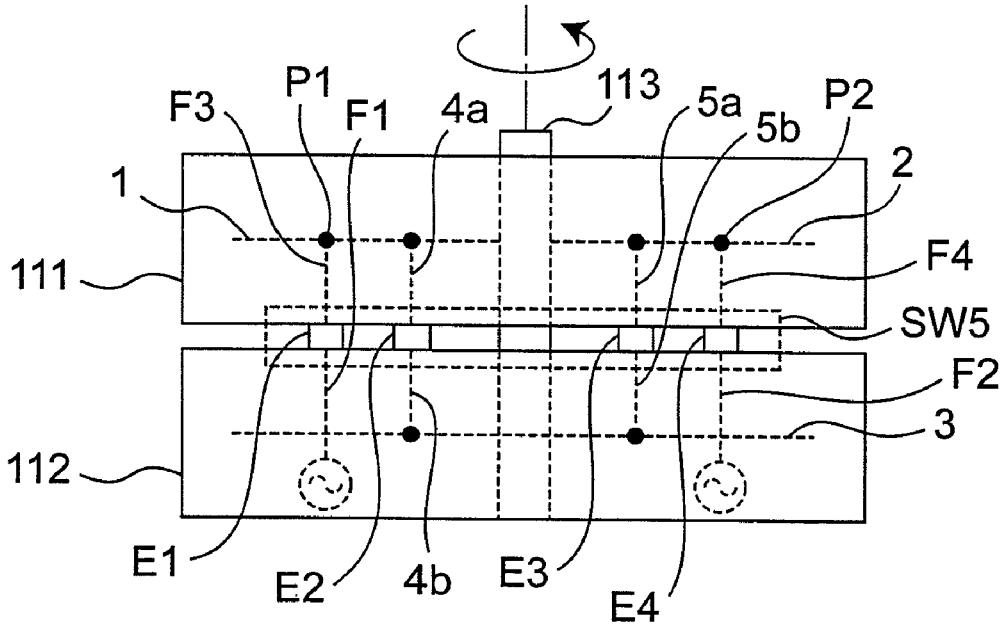
FIG. 22A is a schematic diagram showing a configuration of the mobile phone in its open state as shown in FIG. 21A, as viewed from its bottom and shown in phantom.
Figure 22B:
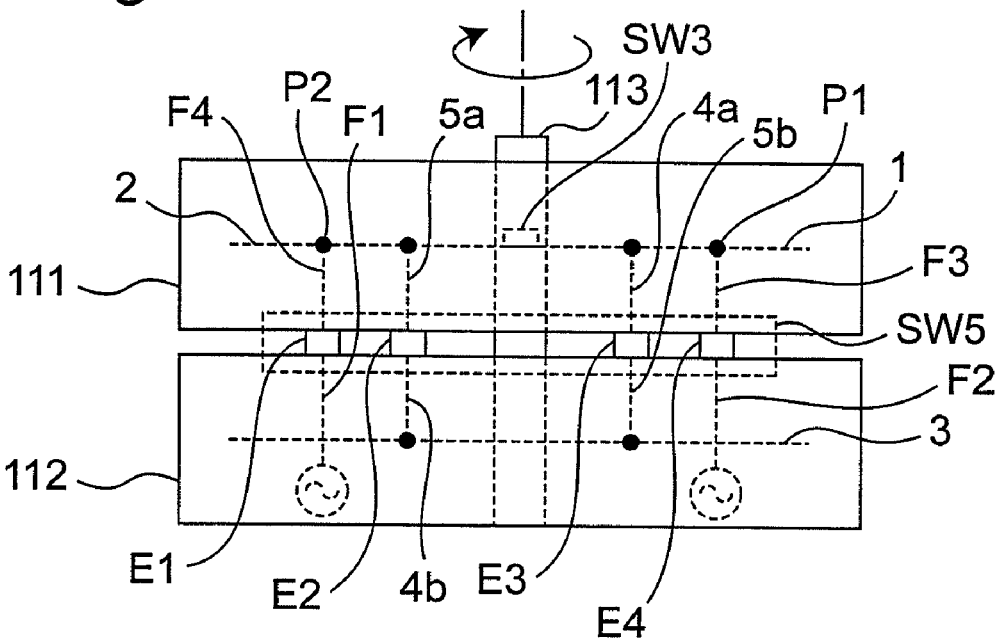
FIG. 22B is a schematic diagram showing a configuration of the mobile phone in its closed state as shown in FIG. 21B, as viewed from its bottom and shown in phantom.

FIG. 22A is a schematic diagram showing a configuration of the mobile phone in its open state as shown in FIG. 21A, as viewed from its bottom and shown in phantom. FIG. 22B is a schematic diagram showing a configuration of the mobile phone in its closed state as shown in FIG. 21B, as viewed from its bottom and shown in phantom. The switch SW5 includes terminals E1, E2, E3, and E4. According to whether the antenna apparatus is opened (FIG. 22A) or closed (FIG. 22B), the terminals E1, E2, E3, and E4 act as follows. The terminal E1 connects the feeding line F3 to the feeding line F1 in the open state, and connects the feeding line F4 to the feeding line F1 in the closed state. The terminal E2 arranges the short-circuit conductors 4*a* and 4*b* to oppose to each other but not to make a electrical connection between them in the open state, and connects the short-circuit conductor 5*a* to the short-circuit conductor 4*b* in the closed state. The terminal E3 arranges the short-circuit conductors 5*a* and 5*b* to oppose to each other but not to make a electrical connection between them in the open state, and connects the short-circuit conductor 4*a* to the short-circuit conductor 5*b* in the closed state. The terminal E4 connects the feeding line F4 to the feeding line F2 in the open state, and connects the feeding line F3 to the feeding line F2 in the closed state.

Figure 23A:
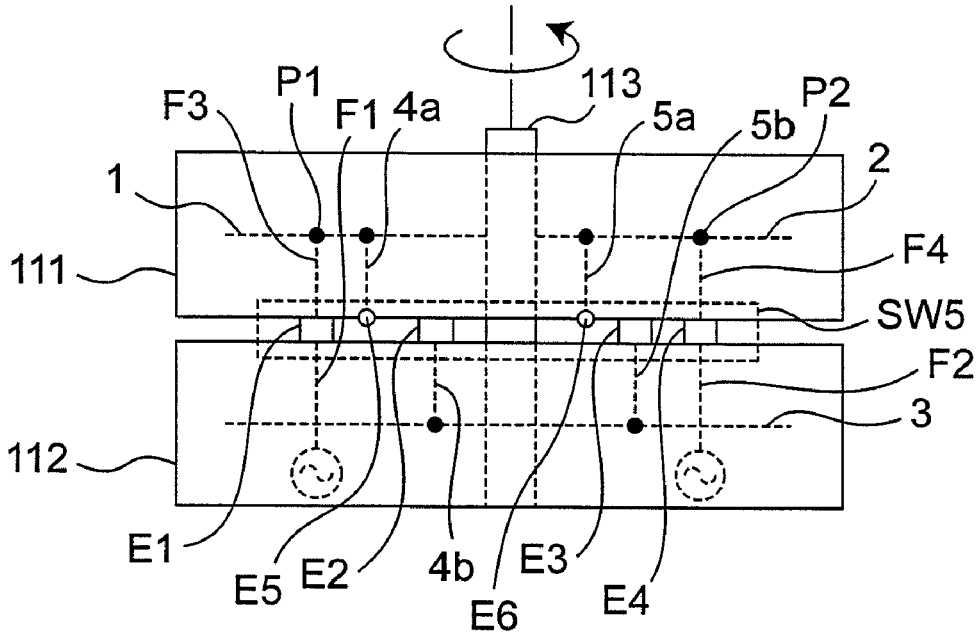
FIG. 23A is a schematic diagram showing a configuration of a mobile phone in its open state, according to a preferred modified embodiment of the second preferred embodiment of the present invention, as viewed from its bottom and shown in phantom.
Figure 23B:
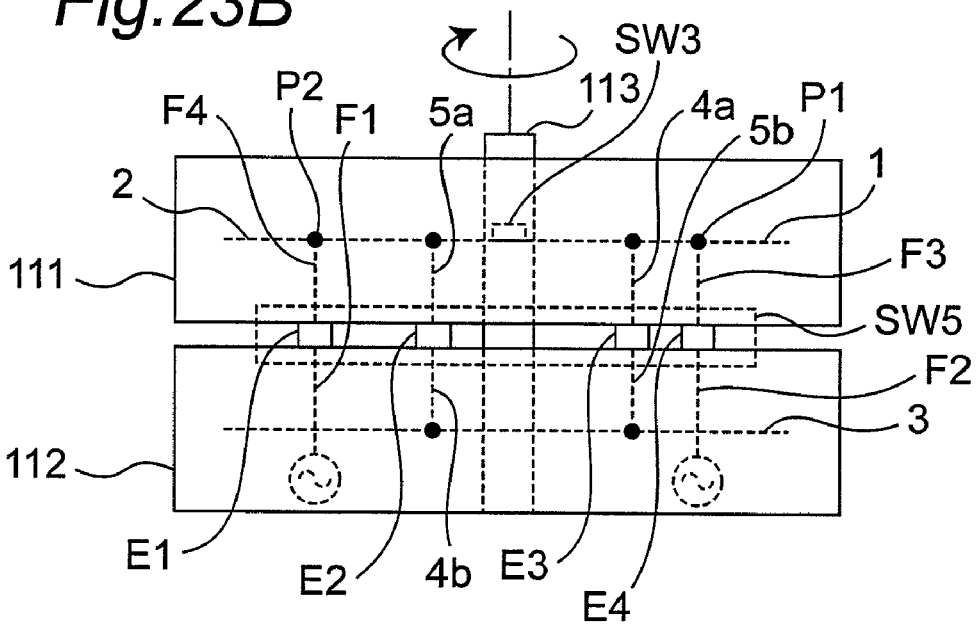
FIG. 23B is a schematic diagram showing a configuration of the mobile phone of FIG. 23A in its closed state, as viewed from its bottom and shown in phantom.

FIG. 23A is a schematic diagram showing a configuration of a mobile phone in its open state, according to a preferred modified embodiment of the second preferred embodiment of the present invention, as viewed from its bottom and shown in phantom. FIG. 23B is a schematic diagram showing a configuration of the mobile phone of FIG. 23A in its closed state, as viewed from its bottom and shown in phantom. The present preferred modified embodiment is characterized by arranging terminals at different distances with respect to a rotating shaft 113 of a housing of the mobile phone, and thus, making electrical connections among short-circuit conductors 4*a*, 4*b*, 5*a*, and 5*b* in the open state and break the connections in the closed state. Referring to FIG. 23A, terminals E1 and E4 are configured in the same manner as in the case of FIGS. 22A and 22B. Each of a terminal E2 connected to the short-circuit conductor 4*b* and a terminal E6 connected to the short-circuit conductor 5*a* is located at a first distance from the rotating shaft 113. Each of a terminal E5 connected to the short-circuit conductor 4*a* and a terminal E3 connected to the short-circuit conductor 5*b* is located at a second distance from the rotating shaft 113, which is different from the first distance. Therefore, when the antenna apparatus is opened, any electrical connection is not made among the short-circuit conductors 4*a*, 4*b*, 5*a*, and 5*b*. On the other hand, referring to FIG. 23B, the terminal E5 moves to the position of the terminal E3 by rotation (not shown), and similarly, the terminal E6 moves to the position of the terminal E2 by rotation (not shown). Therefore, when the antenna apparatus is closed, the short-circuit conductor 5*a* is connected to the short-circuit conductor 4*b*, and the short-circuit conductor 4*a* is connected to the short-circuit conductor 5*b*.

FIG. 24 is a block diagram showing a circuit configuration of the antenna apparatus of FIG. 20A in its open state. FIG. 25 is a block diagram showing a circuit configuration of the antenna apparatus of FIG. 20B in its closed state. Since the connection and disconnection of the short-circuit conductors 4*a*, 4*b*, 5*a*, and 5*b* can be mechanically changed by rotation of the housing of the mobile phone, a controller 16B of the antenna apparatus controls only wireless communication circuits 12 and 14 and the switches SW3 and SW4.

As a preferred modified embodiment, the antenna apparatus according to the present preferred embodiment may be further provided with a variable capacitance diode(s) along the parasitic slit S, as described in the preferred modified embodiments of the first preferred embodiment. The switch SW5 is not limited to one involving mechanical operation; for example, as with the first preferred embodiment, switches SW1 and SW2 to be connected and disconnected under control of a controller of the antenna apparatus may be provided in order to control the connections among the short-circuit conductors 4*a*, 4*b*, 5*a*, and 5*b*.

As described above, antenna apparatuses and mobile phones according to the preferred embodiments of the present invention can transmit or receive, regardless of whether the antenna apparatuses are opened or closed, and furthermore, can simultaneously transmit or receive a plurality of radio signals with low correlations to each other.

A wireless communication apparatus of the present invention can be implemented as a mobile phone for, e.g., MIMO communication. But not limited to MIMO communication, the present invention can also be implemented as a mobile phone that can simultaneously perform communications for multiple applications (multi-application).

As described above, although the present invention is described in detail with reference to preferred embodiments, the present invention is not limited to such embodiments. It will be obvious to those skilled in the art that numerous preferred modified embodiments and altered preferred embodiments are possible within the technical scope of the present invention as defined in the following appended claims.

What is claimed is:

1. A wireless communication apparatus comprising:

first and second housings coupled to each other through a coupling portion so as to change between open and closed states;

first and second antenna elements provided to the first housing with a distance between the first and second antenna elements;

a slit between the first and second antenna elements in the first housing;

first and second feeding points respectively provided on the first and second antenna elements such that the slit is located between the first and second feeding points;

a ground conductor provided to the second housing;

a first switch for electrically connecting and disconnecting the first antenna element to and from the ground conductor; and a second switch for electrically connecting and disconnecting the second antenna element to and from the ground conductor, wherein when the first and second housings are in the open state, the first and second switches are electrically opened, whereby the first antenna element and the ground conductor operate as a first dipole antenna, and the second antenna element and the ground conductor operate as a second dipole antenna with isolation from the first dipole antenna by the slit, and wherein when the first and second housings are in the closed state, the first and second switches are electrically closed, whereby the first antenna element operates as a first inverted F antenna on the ground conductor, and the second antenna element operates as a second inverted F antenna on the ground conductor with isolation from the first inverted F antenna by the slit.

2. The wireless communication apparatus as claimed in claim 1, further comprising:

a third switch for electrically connecting and disconnecting the first and second antenna elements with each other at a first end of the slit;

a fourth switch for electrically connecting and disconnecting the first and second antenna elements with each other at a second end of the slit; and a controller for controlling the third and the fourth switch, wherein when the first and second housings are in the open state, the controller closes the third switch and opens the fourth switch, and when the first and second housings are in the closed state, the controller opens the third switch and closes the fourth switch.

3. The wireless communication apparatus as claimed in claim 2, further comprising:

a first variable capacitance element connected between the first and second antenna elements at the first end of the slit; and a second variable capacitance element connected between the first and second antenna elements at the second end of the slit, wherein when the first and second housings are in the open state, the controller controls a reactance value of the second variable capacitance element so as to minimize reflection coefficients of the first and second dipole antennas, and when the first and second housings are in the closed state, the controller controls a reactance value of the first variable capacitance element so as to minimize reflection coefficients of the first and second inverted F antennas.

4. The wireless communication apparatus as claimed in claim 2, further comprising a variable capacitance element connected between the first and second antenna elements at a position between the first and second ends of the slit, wherein when the first and second housings are in the open state, the controller controls a reactance value of the variable capacitance element so as to minimize reflection coefficients of the first and second dipole antennas, and when the first and second housings are in the closed state, the controller controls the reactance value of the variable capacitance element so as to minimize reflection coefficients of the first and second inverted F antennas.

5. The wireless communication apparatus as claimed in claim 1, further comprising:

a first variable capacitance element connected between the first and second antenna elements at a first end of the slit;

a second variable capacitance element connected between the first and second antenna elements at a second end of the slit; and a controller for controlling the first and second variable capacitance elements, wherein when the first and second housings are in the open state, the controller controls a reactance value of the first variable capacitance element such that the first variable capacitance element is substantially short-circuited, and controls a reactance value of the second variable capacitance element so as to minimize reflection coefficients of the first and second dipole antennas, and when the first and second housings are in the closed state, the controller controls the reactance value of the second variable capacitance element such that the second variable capacitance element is substantially short-circuited, and controls the reactance value of the first variable capacitance element so as to minimize reflection coefficients of the first and second inverted F antennas.

6. The wireless communication apparatus as claimed in claim 2, wherein the controller further controls the first and second switches such that when the first and second housings are in the open state, the first and second switches are electrically opened, and when the first and second housings are in the closed state, the first and second switches are electrically closed.

7. The wireless communication apparatus as claimed in claim 1, wherein the first and second housings are coupled to each other so as to change between the open and closed states in a two-fold manner at the coupling portion.

8. The wireless communication apparatus as claimed in claim 1, wherein the coupling portion includes a rotating shaft that penetrates the first and second housings in their thickness direction, and wherein the first and second housings are coupled to each other so as to change between the open and closed states by rotating about the rotating shaft.

* * * * *